US010925422B2

(12) United States Patent
Amisial

(10) Patent No.: US 10,925,422 B2
(45) Date of Patent: Feb. 23, 2021

(54) FOOD STORING AND SERVING SYSTEM

(71) Applicant: Rubens A. Amisial, Brooklyn, NY (US)

(72) Inventor: Rubens A. Amisial, Brooklyn, NY (US)

( * ) Notice: Subject to any disclaimer, the term of this patent is extended or adjusted under 35 U.S.C. 154(b) by 142 days.

(21) Appl. No.: 16/114,717

(22) Filed: Aug. 28, 2018

(65) Prior Publication Data

US 2020/0069092 A1 Mar. 5, 2020

(51) Int. Cl.

| | |
|---|---|
| ***A47G 21/00*** | (2006.01) |
| ***B65D 6/24*** | (2006.01) |
| ***B65D 6/02*** | (2006.01) |
| *B65D 45/14* | (2006.01) |

(52) U.S. Cl.

CPC ..... *A47G 21/001* (2013.01); *B65D 7/06* (2013.01); *B65D 11/188* (2013.01); *B65D 45/14* (2013.01)

(58) Field of Classification Search

CPC ..... A47G 21/001; B65D 7/06; B65D 11/188; B65D 45/14; B65D 5/6667; B65D 21/086; B65D 2501/24547; B65D 2231/00; B65D 85/1081; B65D 81/2092; B65D 81/203; B65D 90/041; B65D 90/046; B65D 7/24

USPC .... 220/4.23, 4.28, 528, 23.83, 23.86, 23.87, 220/8; 229/101, 103, 125.12

See application file for complete search history.

(56) References Cited

U.S. PATENT DOCUMENTS

| | | | | | |
|---|---|---|---|---|---|
| 968,633 | A * | 8/1910 | Andrews | B65D 21/086 | 220/8 |
| 1,015,455 | A * | 1/1912 | Neesham | B65D 21/086 | 220/8 |
| 1,658,496 | A * | 2/1928 | Qvarnstrom | A45C 11/18 | 206/39 |
| 4,273,249 | A | 6/1981 | Florian | | |
| 4,509,656 | A * | 4/1985 | Rosler | B65D 21/086 | 220/8 |
| 5,056,458 | A * | 10/1991 | Askeland | B05B 12/29 | 118/505 |
| 5,192,019 | A * | 3/1993 | Meehan | B65D 5/0005 | 220/8 |
| 5,632,379 | A | 5/1997 | Frost | | |
| 5,715,962 | A * | 2/1998 | McDonnell | B65D 21/086 | 220/4.03 |
| 5,829,591 | A * | 11/1998 | Lyons | B65D 21/086 | 206/373 |
| 7,464,828 | B1 * | 12/2008 | Unrau | A47K 17/00 | 206/1.5 |
| 7,900,772 | B2 * | 3/2011 | Sack | A61J 1/035 | 206/528 |
| 8,091,709 | B2 * | 1/2012 | Gnepper | B65D 11/12 | 206/536 |
| 8,117,973 | B1 * | 2/2012 | Frank | E05G 1/005 | 109/47 |
| 8,800,795 | B2 * | 8/2014 | Hwang | F25D 3/02 | 206/545 |

(Continued)

*Primary Examiner* — Kareen K Thomas
(74) *Attorney, Agent, or Firm* — Tutunjian & Bitetto, P.C.

(57) ABSTRACT

Systems are provided for storing and serving a food product. The systems can include a base portion, a top portion, and a mechanism for raising and lowering the food product relative to the base portion, and are configured to prevent spillage and/or leakage of any portion of the food product during storage and consumption of the food product.

16 Claims, 22 Drawing Sheets

(56) References Cited

U.S. PATENT DOCUMENTS

| | | | | |
|---|---|---|---|---|
| 2006/0000681 | A1* | 1/2006 | Barker | A45C 7/0031 190/18 A |
| 2007/0289964 | A1* | 12/2007 | Mazzucchelli | E05B 73/0023 220/8 |
| 2009/0179030 | A1* | 7/2009 | Lang | B65D 5/32 220/8 |
| 2012/0138607 | A1* | 6/2012 | Mattox | B65D 21/086 220/8 |
| 2013/0062234 | A1* | 3/2013 | Roesler | B65D 21/086 206/349 |
| 2014/0027470 | A1* | 1/2014 | Pelfrey | B65D 21/086 222/105 |
| 2014/0224795 | A1* | 8/2014 | Parnall | B65D 90/14 220/7 |
| 2016/0251150 | A1* | 9/2016 | Macchi | A23F 5/262 426/115 |

* cited by examiner

FOOD STORING AND SERVING SYSTEM

BACKGROUND

Technical Field

The present invention generally relates to containers for food products, and more particularly to handheld containers for storing, transporting, and serving food products.

Description of the Related Art

Food products which are consumed while being held in the hand of a consumer are commonplace. Such food products can include, for example, sliced bread sandwiches, hamburgers, roll sandwiches, hero sandwiches, hot dogs, etc., and are commonly served in restaurants (e.g., fast food restaurants). Consumers often purchase these types of food products as take-out items (e.g., drive-up windows, carry out of restaurant, etc.) for later consumption while the consumer is, for example, in a vehicle, walking, sitting on a bench, etc., and is not transferring the food product (e.g., to a plate) while eating the food product while sitting at a table.

While it is convenient, and time saving, to consume food products while on the go (e.g., while held in the hand of a consumer) rather than in a traditional, sit-down manner (e.g., using a plate while seated at a table), many food products which may be consumed while being held in the hand of a consumer, such as sandwiches, can include various components (e.g., bread, meat, tomatoes, lettuce, dressing, ketchup, onions, mayonnaise, etc.) which may spill or fall onto, for example, a consumer's clothing, car interior, etc., while consuming the food product (e.g., a sandwich). Some food products (e.g., fast food sandwiches) are placed in containers (e.g., paper clam-shell container), but these containers require removing the sandwich from the container to consume the sandwich. Some conventional containers are configured for eating a sandwich without removing the sandwich from the container (e.g., open top box), but these containers require a consumer to reposition and lift the sandwich using their hands to extend the sandwich beyond the open top box for consumption. Thus, there is a need for an improved food storing and serving system which resolves at least the above-deficiencies present in conventional systems.

SUMMARY

In accordance with an embodiment of the present invention, a system for storing and serving a food product is provided. The system can include a bottom portion configured for receiving the food product. The bottom portion can include a first side bottom portion formed as an open top box-like structure including a first end wall portion, two first side wall portions, and a first base portion, with the first base portion being separated from the side wall portions by a slit on opposing sides of the base portion to form a flap-like platform. The slit extends laterally from an approximate midpoint of the base portion to an end length of the first side wall portions. The system further can include a second side bottom portion formed as an open top box-like structure including a second end wall portion, two second side wall portions, and a second base portion including a cutout at an approximate midpoint of the second base portion, and the cutout is configured for receiving the platform. Pivot points are positioned at the approximate midpoint of the side wall portions of the first side bottom portion and the second side bottom portion for pivotally fastening the first side bottom portion and the second side bottom portion, and the bottom portion is further configured to raise or lower the food product by pivoting the end wall portions about the pivot points.

In accordance with an embodiment of the present invention, a system for storing and serving a food product is provided. The system can include an open top box-like bottom portion configured for receiving the food product, the bottom portion having four side walls and an end wall, and having a substantially rectangular cutout extending longitudinally on a first side wall. An insert is positioned inside the bottom portion and adjacent the end wall. The insert can include a base portion configured for supporting the food product, and a handle attached to the base portion. The handle protrudes outwardly through the cutout, and is configured to change a position of the base portion relative to the bottom portion by sliding the handle along the cutout.

In accordance with an embodiment of the present invention, a system for storing and serving a food product is provided. The system can include an open top box-like bottom portion configured for receiving the food product, the bottom portion having four side walls and an bottom wall, with the bottom wall having a cutout forming a ledge along a bottom edge of the four side walls. An insert is positioned inside the bottom portion, and the insert is configured for receiving the food product.

These and other features and advantages will become apparent from the following detailed description of illustrative embodiments thereof, which is to be read in connection with the accompanying drawings.

BRIEF DESCRIPTION OF THE DRAWINGS

The following description will provide details of preferred embodiments with reference to the following figures wherein.

DETAILED DESCRIPTION

Figure 1A:
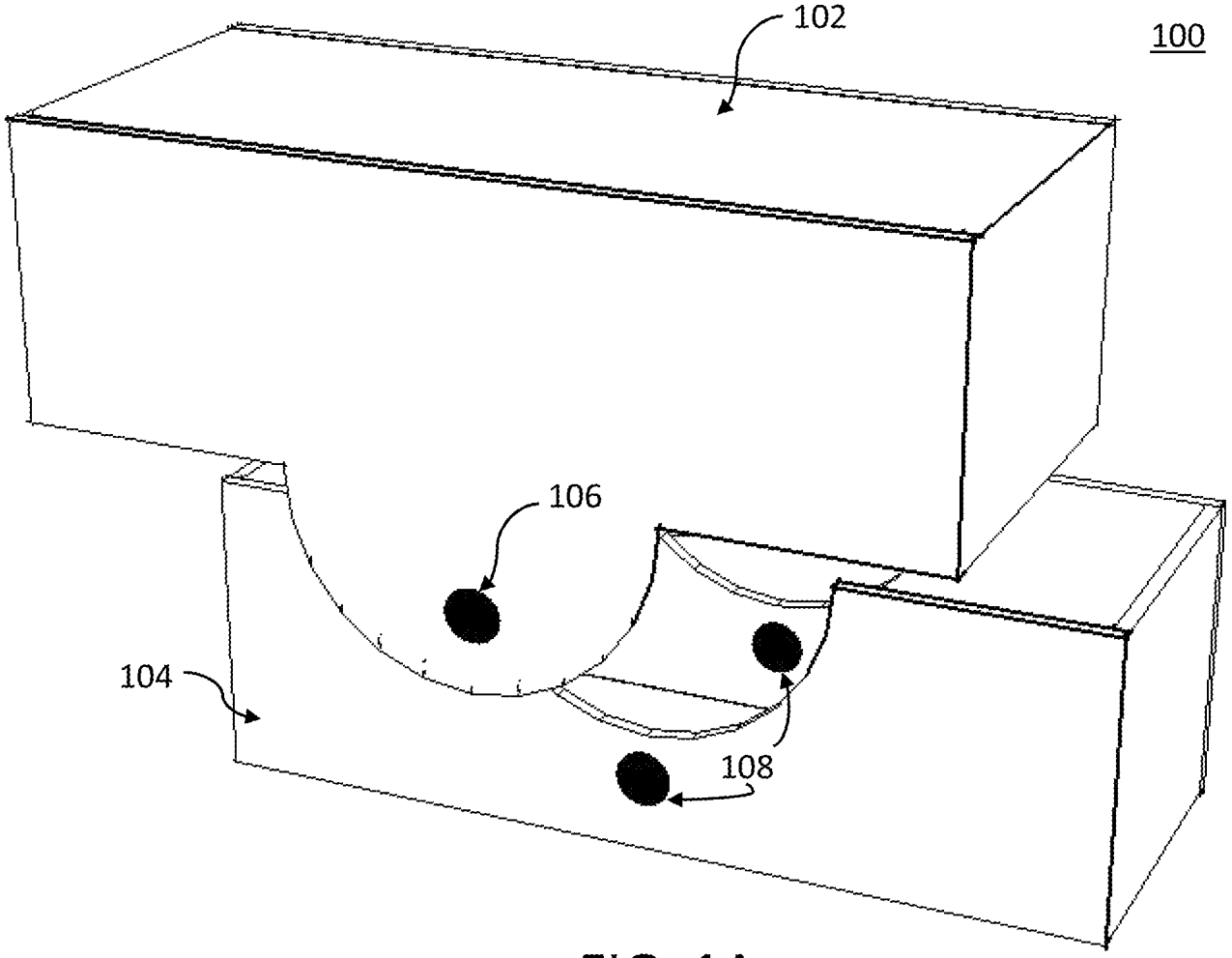
FIG. 1A is a perspective view showing components of a food serving system, in accordance with an embodiment of the present invention.

The present invention generally relates to containers for food products, and more particularly to handheld containers for storing, serving and consuming food products (e.g., sliced bread sandwich, hamburger, roll sandwich, hero sandwich, hot dog, etc.) in accordance with various embodiments. An aspect of the present invention is to provide a handheld protective container configured for storing, transporting, serving, and raising the food products inside the container for ease of consumption of the food products while minimizing any potential spillage or dropping of any portion of the food products (e.g., juices, condiments, sauces, crumbs, toppings, etc.) during consumption of the food product by a consumer, in accordance with various embodiments.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value can include at least that particular value, unless the context clearly dictates otherwise. Ranges may be expressed herein as from "about" or "approximately" one particular value and/or to "about" or "approximately" another particular value. When such a range is expressed, another embodiment can include from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Referring now to FIGS. 1A-1F of the drawings, in which like numerals represent the same or similar elements, and initially to FIG. 1A, a perspective view showing components of a food storing/serving system 100 in an assembled state is illustratively depicted in accordance with an embodiment of the present invention.

The components of the food storing/serving system 100 can be fabricated from any material suitable for packaging or serving food, including, for example, paper, cardboard, plastics, metals, polymers, ceramics, semi-rigid/rigid materials, rubbers, silicone, Styrofoam, etc., as readily understood by one of ordinary skill in the art. In accordance with various embodiments of the present invention, some or all components of the food storing/serving system 100 can be configured to be disposable (e.g., a paper, cardboard, Styrofoam, etc. fast food-type container), or non-disposable (e.g., a plastic, metal, rubber, etc. travel sandwich container). Of course, in accordance with various embodiments, the food storing/serving system 100 may also include other elements (not shown), and may be formed from any suitable materials, as readily contemplated by one of skill in the art, as well as omit certain elements.

In one embodiment, the food storing/serving system 100 is a hollow, box-like container suitable for storing/carrying a food item (e.g., sandwich, hamburger, etc.). The system 100 can include an open-top box-like bottom portion 104 configured for receiving a food item. In some embodiments, the bottom portion 104 can include semi-circular cutouts on two opposing sides of the bottom portion 104. The bottom portion 104 may be formed from two portions, Side A 110, and Side B 120 (shown in FIG. 1C), and pivotally fastened together at pivot points/joints 108 on two opposing sides of the bottom portion 104. The pivot points/joints 108 may be constructed from any appropriate material (e.g., metal, plastic, paper, etc.), and may be formed from any appropriate type of pivotable connector (e.g., plastic snap connector, barrel nut, connector bolt, magnetic connectors, rivets, folded paper fasteners, etc.) in accordance with various embodiments.

In one embodiment, the system 100 can include an open-bottom box-like top portion 102, configured for receiving a food item, and the top portion 102 can include semi-circular flap-like portions which extend over the bottom portion 104 when the system is in a closed state (e.g., top portion 102 placed securely onto bottom portion 104). In some embodiments, the top portion 102 can include a mechanism 106 for closure of the container system 100 during storage/transport. The mechanism 106 may be, for example, a snap-type closure which snaps onto a portion of the pivot points/joints 108, a magnetic closure, or any suitable closure mechanism, as readily appreciated by those of ordinary skill in the art. The top portion 102 may be detachable, and may be used as a holder for sides (e.g., french fries, sliced fruit, etc.), condiments (e.g., dipping sauces, ketchup, etc.) in accordance with various embodiments of the present invention.

Figure 1B:
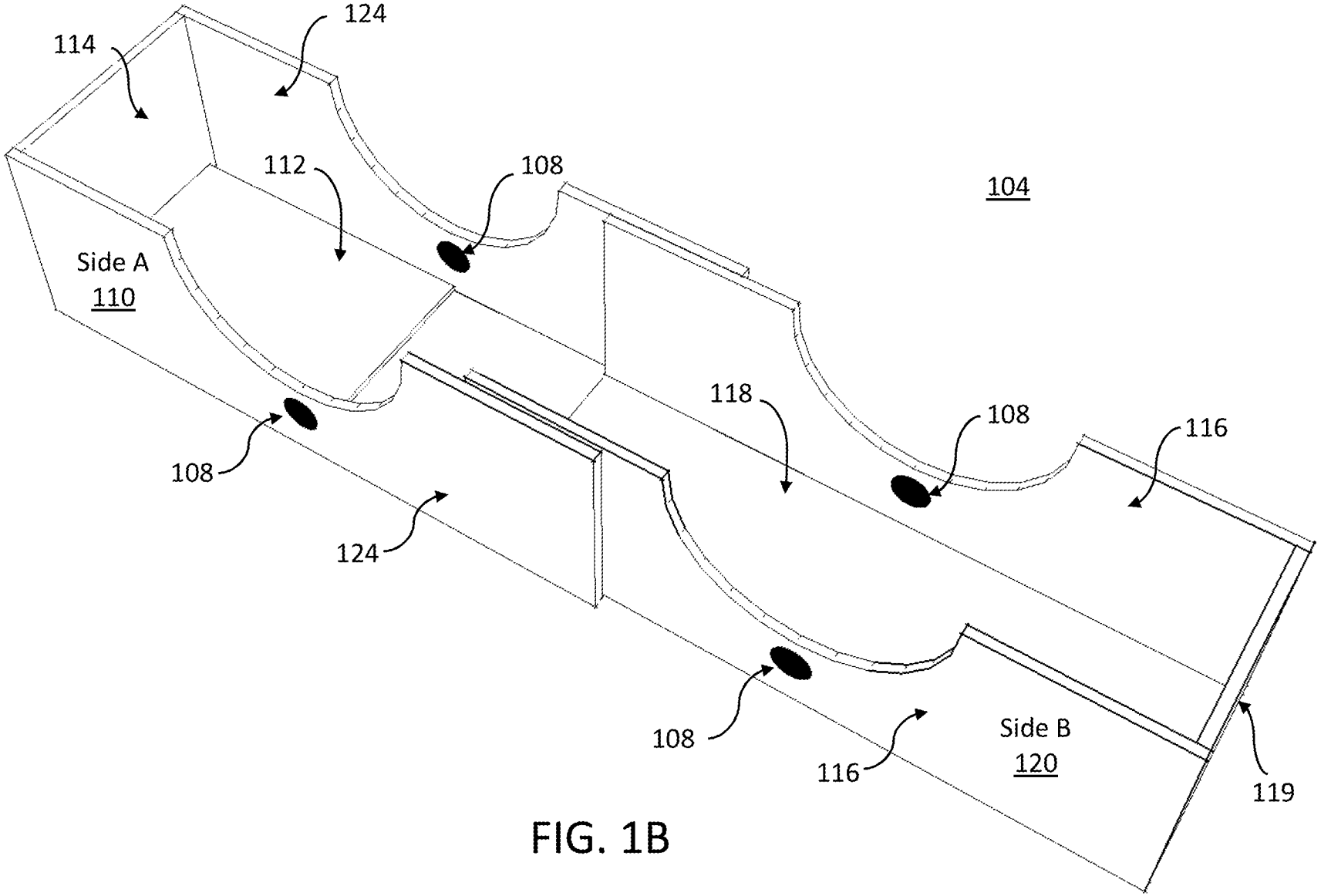
FIG. 1B is a top perspective view of components of a bottom portion of the system shown in FIG. 1A, with parts separated, in accordance with an embodiment of the present invention.

Referring now to FIG. 1B, with continued reference to FIG. 1A, a perspective view of components of a bottom portion 104 of the system 100 shown in FIG. 1A, with parts separated, is illustratively depicted in accordance with an embodiment of the present invention. In one embodiment, the bottom portion 104 of the system 100 is formed from two portions, Side A 110 and Side B 120. Side A 110 is formed as an open top box-like structure including an end wall portion 114, two side wall portions 124, a base portion 112, and pivot points/joints 108 configured for pivotally fastening Side A 110 to Side B 120 on opposing sides of the bottom portion 104. The base portion 112 extends laterally to approximately the mid-point of the length of the side wall portions 124, or approximately the mid-point of the openings 108, in accordance with various embodiments of the present invention.

In one embodiment, Side B 120 is formed as an open top box-like structure including an end wall portion 119, two side wall portions 116, a base portion 118, and openings 108 configured for pivotally fastening Side B 120 to Side A 110 at pivot points/joints 108 on opposing sides of the bottom portion 104. The base portion 118 extends laterally to a length equal to, or less than the length of the side wall portions 116, in accordance with various embodiments of the present invention.

In some embodiments, Side A 110 and Side B 120 are configured to be pivotally attached to each other at pivot points/joints 108 such that a food product (e.g., sandwich) is raised during consumption by a user, described in further detail hereinbelow with reference to FIG. 1C. The bottom portion 104, when assembled, is configured such that by holding Side A 110 and Side B 120 in the hands of a user, and pivoting Side A 110 and Side B 120 away from each other in a downward motion about the pivot point (not shown), the food product will be elevated by the system 100 to provide easy access to the food product throughout consumption by a user. It is noted that the bottom portion 104 of the system 100 is described as having two distinct parts (e.g., Side A 110 and Side B 120) herein for illustrative purposes, but it is to be appreciated that the bottom portion 104 off the system 100 may be constructed as a single piece in accordance with various embodiments of the present principles.

Figure 1C:
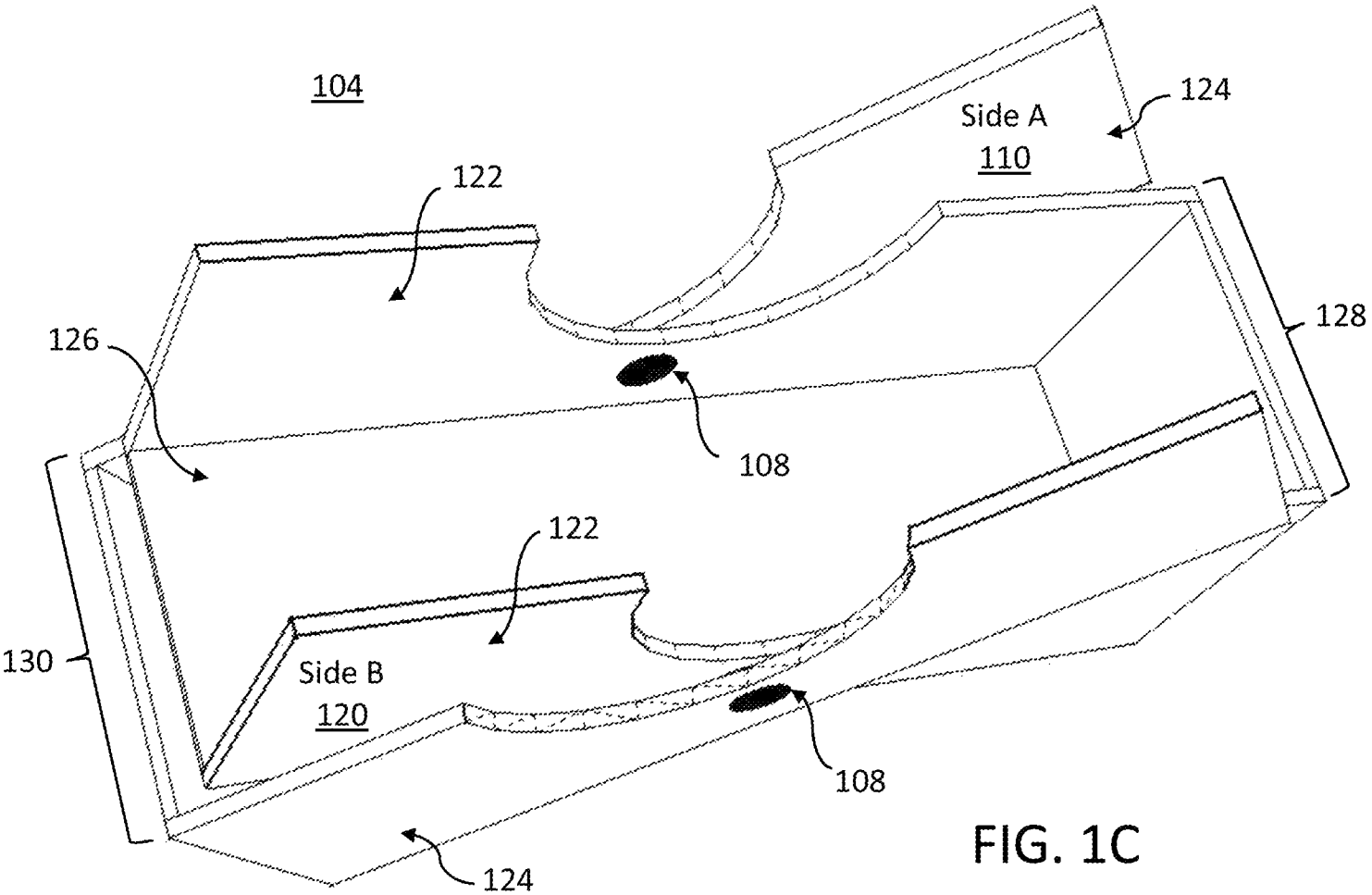
FIG. 1C is a top perspective view of components of a bottom portion of the system shown in FIG. 1A, in accordance with an embodiment of the present invention.

Referring now to FIG. 1C, with continued reference to FIGS. 1A and 1B, a perspective view of assembled components of a bottom portion 104 of the system 100 shown in FIG. 1A is illustratively depicted in accordance with an embodiment of the present invention. In one embodiment, Side A 110 and Side B 120 are configured to be pivotally fastened to each other at pivot points/joints 108 positioned on the side wall portions 124 of Side A 110 and the side wall portions 122 of Side B 120. The side walls 122 of Side B 120 are configured to fit snugly inside the side walls 124 of Side A 110 (e.g., Side B 120 width 128 is smaller than Side A 110 width 130) while allowing sufficient space to prevent excessive rubbing of the side walls 122, 124 against each other while pivoting Side A 110 and Side B 120 during use.

In one embodiment, Side A 110 and Side B 120 are configured to be pivoted such that a food product (e.g., sandwich) is raised by the resulting movement of the base portion 126 of Side B 120 during consumption of the food product by a user. The bottom portion 104 is configured for serving a food product such that by holding Side A 110 and Side B 120 in the hands of a user, and pivoting Side A 110 and Side B 120 away from each other in a downward motion about the pivot point joints 108, the food product is elevated relative to the bottom portion 104 of the system 100 to provide easy access to a food product throughout consumption by a user, in accordance with various embodiments of the present invention.

Figure 1D:
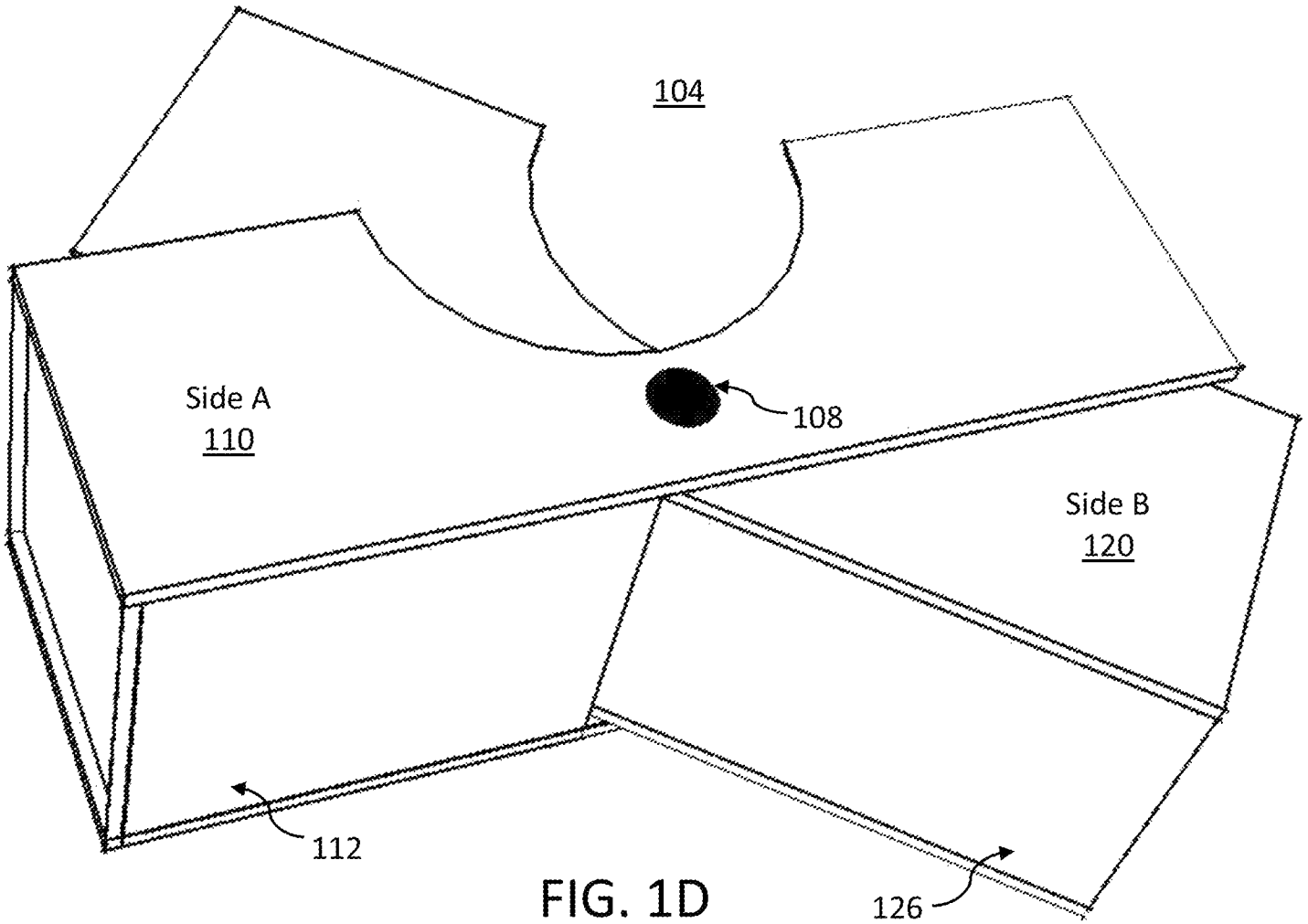
FIG. 1D is a bottom perspective view of components of a bottom portion of the system shown in FIG. 1A, in accordance with an embodiment of the present invention.

Referring now to FIG. 1D, with continued reference to FIGS. 1A-1C, a perspective view of components of a bottom portion 104 of the system 100 shown in FIG. 1A is illustratively depicted in accordance with an embodiment of the present invention. In one embodiment, Side A 110 and Side B 120 are configured to be pivotally fastened to each other at pivot points/joints 108 positioned on the side wall portions 124 (shown in FIG. 1C) of Side A 110 and the side wall portions (shown in FIG. 1C) of Side B 120. The bottom portion 112 of Side A 110 is used as support for a food product while the bottom portion 104 of the system 100 is in a resting state (e.g., not being pivoted about the pivot points/joints 108). The bottom portion 126 of Side B 120 may be configured to receive, support, and raise a food product during consumption of the food product by the user in accordance with various embodiments of the present invention.

Figure 1E:
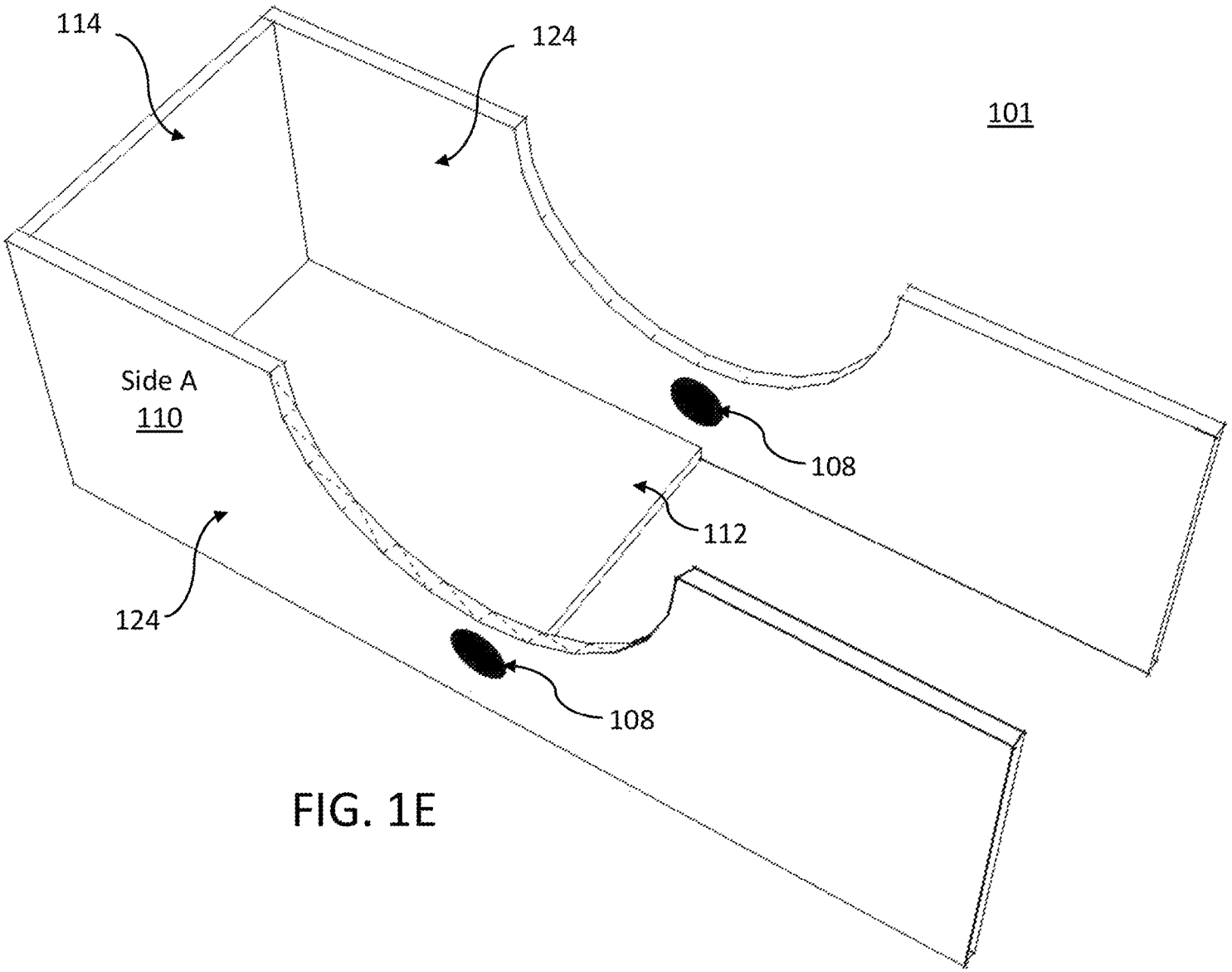
FIG. 1E is a top perspective view of a separated section of a bottom portion of the system shown in FIG. 1A, in accordance with an embodiment of the present invention.

Referring now to FIG. 1E, with continued reference to FIGS. 1A-1D, a top perspective view of a separated section 101 of a bottom portion of the system 100 shown in FIG. 1A is illustratively depicted in accordance with an embodiment of the present invention. In one embodiment, the bottom portion of the system 100 is formed from two portions, Side A 110 and Side B 120 (shown in FIG. 1C). Side A 110 is formed as an open top box-like structure including an end wall portion 114, two side wall portions 124, a base portion 112, and pivot points/joints 108 configured for pivotally fastening Side A 110 to Side B 120 (shown in FIG. 1C) at pivot points/joints 108 on opposing sides of the side wall portions 124 of Side A 110. The base portion 112 extends laterally to approximately the mid-point of the length of the side wall portions 124, or approximately the mid-point of the pivot points/joints 108, in accordance with various embodiments of the present invention.

Figure 1F:
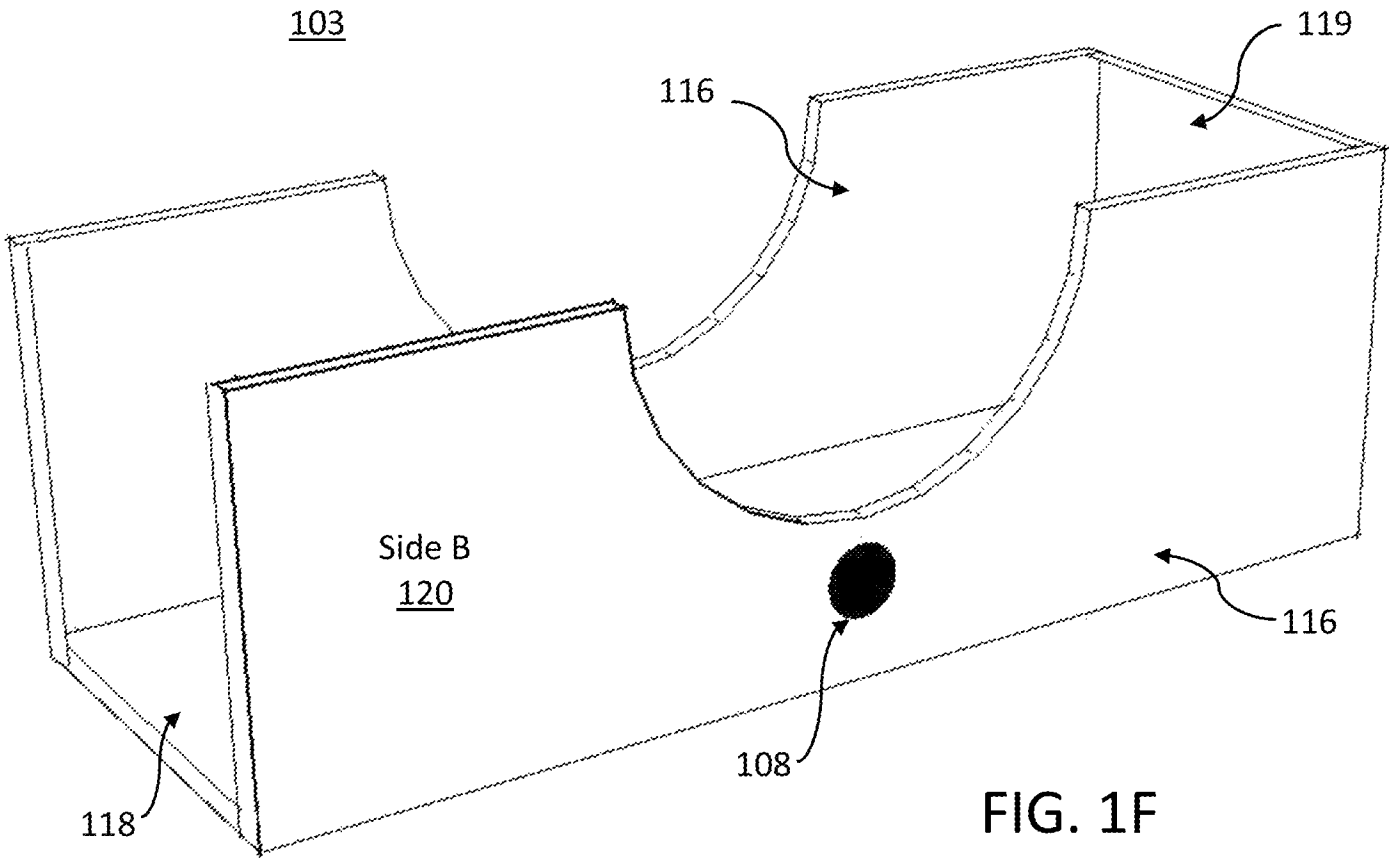
FIG. 1F is a side perspective view of a separated section of a bottom portion of the system shown in FIG. 1A, in accordance with an embodiment of the present invention.

Referring now to FIG. 1F, with continued reference to FIGS. 1A-1E, a side perspective view of a separated section 103 of a bottom portion of the system 100 shown in FIG. 1A is illustratively depicted in accordance with an embodiment of the present invention. In one embodiment, the bottom portion of the system 100 is formed from two portions, Side A 110 (shown in FIG. 1C) and Side B 120. Side B 120 is formed as an open top box-like structure including an end wall portion 119, two side wall portions 116, a base portion 118, and pivot points/joints 108 configured for pivotally fastening Side B 120 to Side A 110 (shown in FIG. 1C) on opposing sides of the side wall portions 116 of Side B 120. The base portion 118 extends laterally to a length equal to, or less than the length of the side wall portions 116, in accordance with various embodiments of the present invention.

Figure 2A:
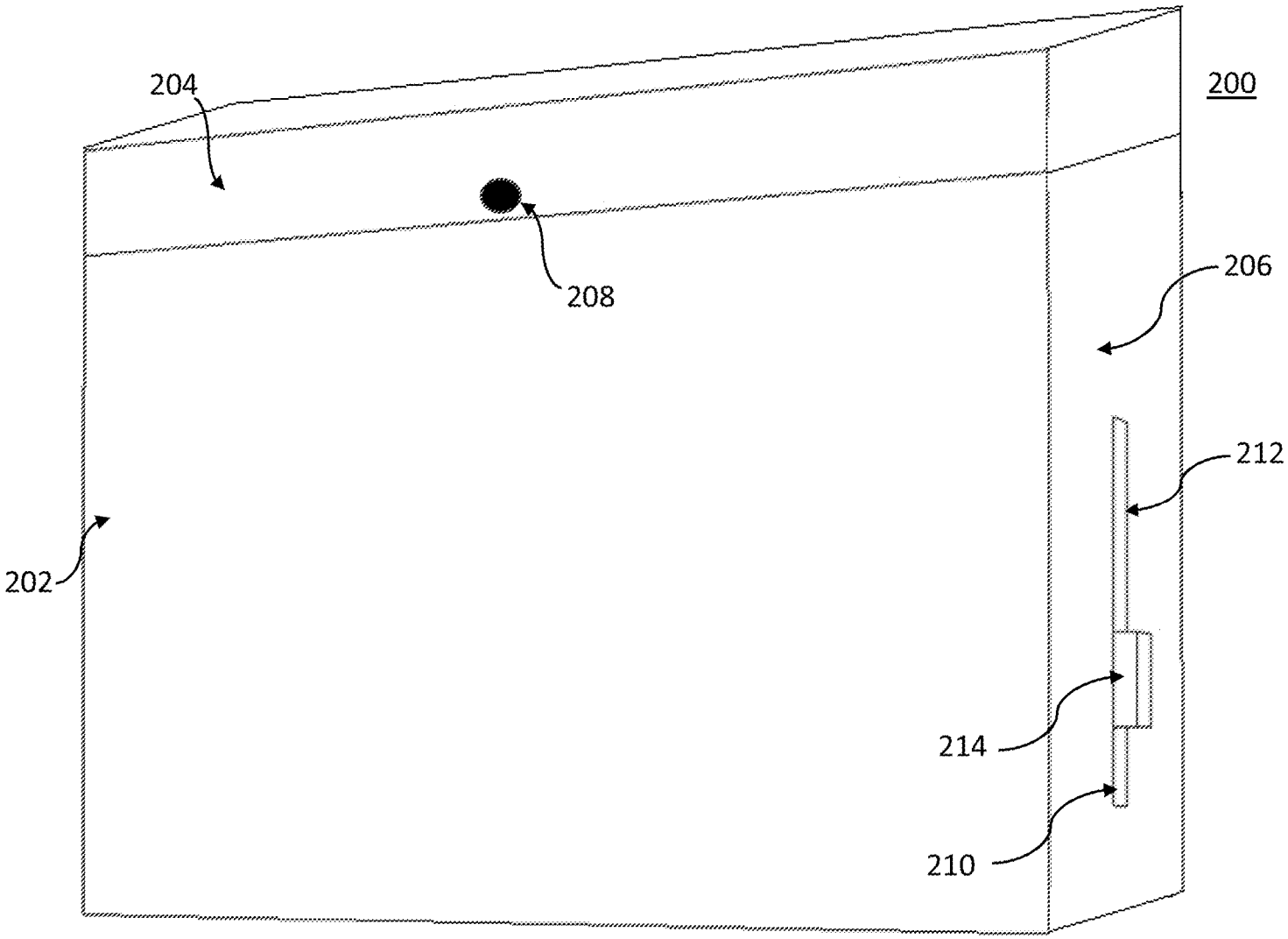
FIG. 2A is a perspective view showing components of a food serving system, in accordance with an embodiment of the present invention.

Referring now to FIGS. 2A-2D of the drawings, in which like numerals represent the same or similar elements, and initially to FIG. 2A, a perspective view showing components of a food storing/serving system 200 is illustratively depicted in accordance with an embodiment of the present invention.

The components of the food storing/serving system 200 can be fabricated from any material suitable for packaging or serving food, including, for example, paper, cardboard, plastics, metals, polymers, ceramics, semi-rigid/rigid materials, rubbers, silicone, Styrofoam, etc., as readily understood by one of ordinary skill in the art. For example, in some embodiments, the components of the food storing/serving system 200, individually or collectively, can be fabricated from materials such as semi-rigid paper with plastic pivot point bolts/dowels/connectors, which will be described in further detail hereinbelow. In some embodiments of the present invention, the components of the food storing/serving system 200 can be configured to be, for example, disposable (e.g., paper, cardboard, Styrofoam, etc. fast food-type container), or non-disposable (e.g., plastic, metal, rubber, etc. travel sandwich container). Of course, in accordance with various embodiments, the food storing/serving system 200 may also include other elements (not shown), and may be formed from any suitable materials, as readily contemplated by one of skill in the art, as well as omit certain elements.

In one embodiment, the food storing/serving system 200 is a hollow, box-like container suitable for storing/carrying a food item (e.g., sandwich, hamburger, etc.). The system 200 can include an open-top box-like bottom portion 202 configured for receiving a food item, and may include a hingedly connected top portion 204 or an open-bottom box-like top portion (not shown) configured to snugly fit onto the top portion in accordance with various embodiments of the present invention. In some embodiments, the top portion 204 can include a mechanism 208 for closure of the container system 200 during storage/transport. The mechanism 208 may be, for example, a snap-type closure which snaps onto a corresponding connector on the bottom portion 202, a magnetic closure, or any suitable closure mechanism, as readily appreciated by those of ordinary skill in the art. The top portion 204 may be detachable, and may be used as a holder for sides (e.g., french fries, sliced fruit, etc.), condiments (e.g., dipping sauces, ketchup, etc.) in accordance with various embodiments of the present invention.

In one embodiment, a side wall portion 206 of the bottom portion 202 may include a slit/cutout 210, which may be positioned at or near the midpoint of the width of the side wall portion 206. The cutout/slit 210 may extend vertically on the side wall portion 206 from the base of the side wall portion 206 to the top of the side wall portion 206, or in any of a plurality of substantially vertical lengths, in accordance with various embodiments. A barrier 212 (e.g., plastic film, accordion-like paper/plastic/rubber, etc.) may be affixed to an upper portion of the interior side of the side wall portion 206 such that when a handle mechanism 214 (e.g., plastic/paper semi-rigid protrusion, hook, block-like slider, etc.) is raised vertically with respect to the base of the bottom portion 202, an attached food product holder (shown in FIG. 2B), the barrier 212, and any food product in the food product holder (shown in FIG. 2B) is also raised to provide easy access to the food product throughout consumption by a user, in accordance with various embodiments of the present invention. The barrier 212 prevents any food product from leaking/spilling through the cutout/slit 210 during consumption.

In some embodiments, a cutout/slit 210, a barrier 212, and two handle mechanisms 214 may be positioned on two opposing side portions 206, and may function to cooperatively to lift the food product in the food product holder 216 vertically during use of the system 200, which is described in further detail herein below with reference to FIG. 2C in accordance with various embodiments of the present invention.

Figure 2B:
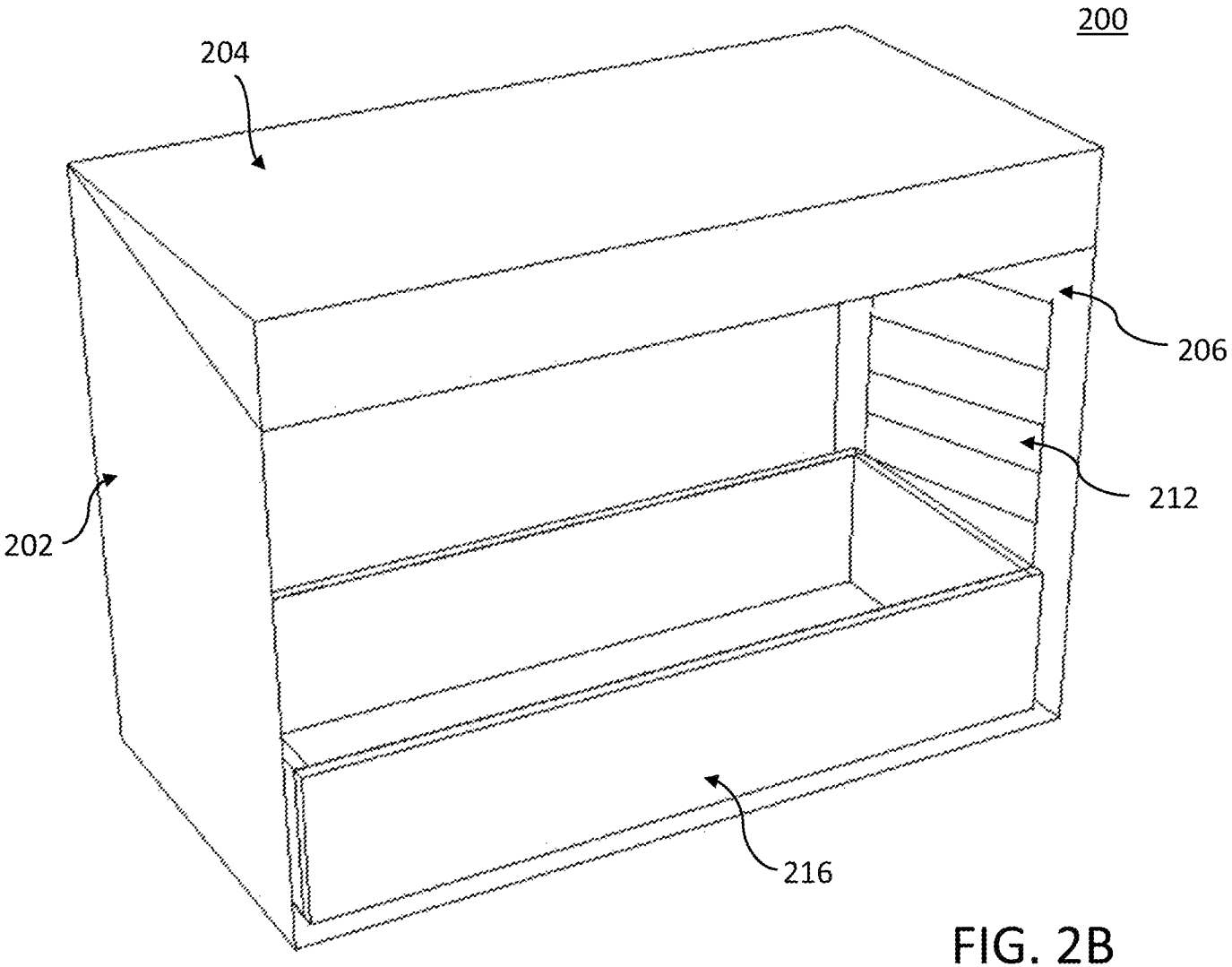
FIG. 2B is a cross-sectional side perspective view of components of the system shown in FIG. 2A, in accordance with an embodiment of the present invention.

Referring now to FIG. 2B, with continued reference to FIG. 2A, a cross-sectional side perspective view of components of the system 200 shown in FIG. 2A is illustratively depicted in accordance with an embodiment of the present invention. In one embodiment, the food storing/serving system 200 is a hollow, box-like container suitable for storing/carrying a food item (e.g., sandwich, hamburger, etc.). The system 200 can include an open-top box-like bottom portion 202 configured for receiving a food item, and may include a hingedly connected top portion 204 or an open-bottom box-like top portion (not shown) configured to snugly fit onto the top portion in accordance with various embodiments of the present invention. In some embodiments, the top portion 204 may be detachable, and may be used as a holder for sides (e.g., french fries, sliced fruit, etc.), condiments (e.g., dipping sauces, ketchup, etc.).

In one embodiment, one of the side wall portions 206 of the bottom portion 202 may include a slit/cutout (shown in FIG. 2A), which may be positioned at or near the midpoint of the width of one or more side wall portions 206 of the bottom portion 202. The cutout/slit (shown in FIG. 2A) may extend vertically on the side wall portion 206 from the base of the side wall portion 206 to the top of the side wall portion 206, or in any of a plurality of substantially vertical lengths, in accordance with various embodiments. A barrier 212 (e.g., plastic film, accordion-like paper/plastic/rubber, etc.) may be affixed to an upper portion of the interior side of the side wall portion 206 such that when a handle mechanism (shown in FIG. 2A) (e.g., plastic/paper semi-rigid protrusion, hook, block-like slider, etc.) is raised vertically with respect to the base of the bottom portion 202, a food product holder 216 and any food product in the food product holder 216 is also raised to provide easy access to the food product throughout consumption by a user, in accordance with various embodiments of the present invention. The food product holder 216 may be attached to the handle (shown in FIG. 2A) and/or the barrier 212. The barrier 212 prevents any food product from leaking/spilling through the cutout/slit 210 during consumption.

In some embodiments, a cutout/slit 210, a barrier 212, and two handle mechanisms 214 may be positioned on two opposing side portions 206, and may function cooperatively to lift the food product in the food product holder 216 vertically during use of the system 200, which is described in further detail herein below with reference to FIG. 2C in accordance with various embodiments of the present invention.

Figure 2C:
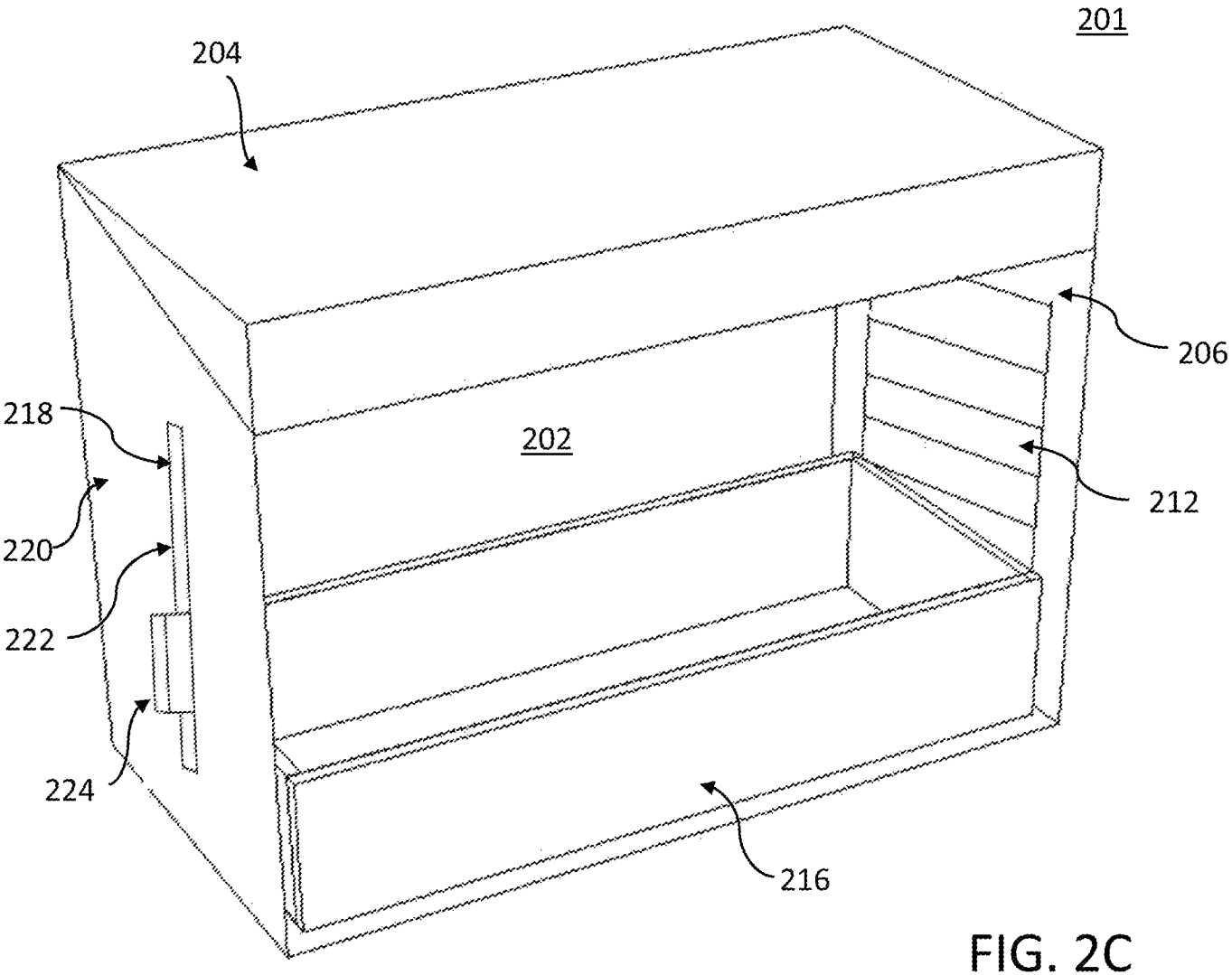
FIG. 2C is a side perspective view of components of the system shown in FIG. 2A, with parts separated, in accordance with an embodiment of the present invention.

Referring now to FIG. 2C, with continued reference to FIGS. 2A and 2B, a cross-sectional side perspective view of components 201 of the system 200 shown in FIG. 2A is illustratively depicted in accordance with an embodiment of the present invention. In one embodiment, the food storing/serving system 200 is a hollow, box-like container suitable for storing/carrying a food item (e.g., sandwich, hamburger, etc.). The system 200 can include an open-top box-like bottom portion 202 configured for receiving a food item, and may include a hingedly connected top portion 204 or an open-bottom box-like top portion (not shown) configured to snugly fit onto the top portion in accordance with various embodiments of the present invention. In some embodiments, the top portion 204 may be detachable, and may be used as a holder for sides (e.g., french fries, sliced fruit, etc.), condiments (e.g., dipping sauces, ketchup, etc.).

In one embodiment, opposing side wall portions 220, 206 of the bottom portion 202 each can include a slit/cutout 222, 210 (shown in FIG. 2A) on opposing side wall portions 220, 206 of the bottom portion 202. The slits/cutouts 222, 210 (shown in FIG. 2A) may be positioned at or near the midpoint of the width of the opposing side wall portions 220, 206 of the bottom portion 202. The slits/cutouts 222, 210 (shown in FIG. 2A) may extend vertically on the opposing side wall portions 220, 206 from the base of the opposing side wall portions 220, 206 to the top of the opposing side wall portions 220, 206, or in any of a plurality of substantially vertical lengths, in accordance with various embodiments. Barriers 218, 212 (e.g., plastic film, accordion-like paper/plastic/rubber, etc.) may be affixed to an upper portion of the interior side of the side wall portions 220, 206 such that when handle mechanisms 224, 214 (shown in FIG. 2A) (e.g., plastic/paper semi-rigid protrusion, hook, block-like slider, etc.), which are functionally connected to a food product holder 216, are raised vertically with respect to the base of the bottom portion 202, the food product holder 216 and any food product in the food product holder 216 is also raised to provide easy access to the food product throughout consumption by a user, in accordance with various embodiments of the present invention.

In accordance with various embodiments, the food product holder 216 may be attached to the handles 224, 214 (shown in FIG. 2A) and/or the barriers 218, 212, in accordance with the present invention. The barriers 218, 212 prevents any food product from leaking/spilling through the slits/cutouts 222, 210 (shown in FIG. 2A) during consumption. In some embodiments, the slits/cutouts 222, 210 (shown in FIG. 2A), the barriers 218, 212, and the handle mechanisms 224, 214 (shown in FIG. 2A) are positioned on two opposing side wall portions 220, 206, and the two handle mechanisms 224, 214 (shown in FIG. 2A) function cooperatively to lift the food product vertically during use of the system 200.

Figure 2D:
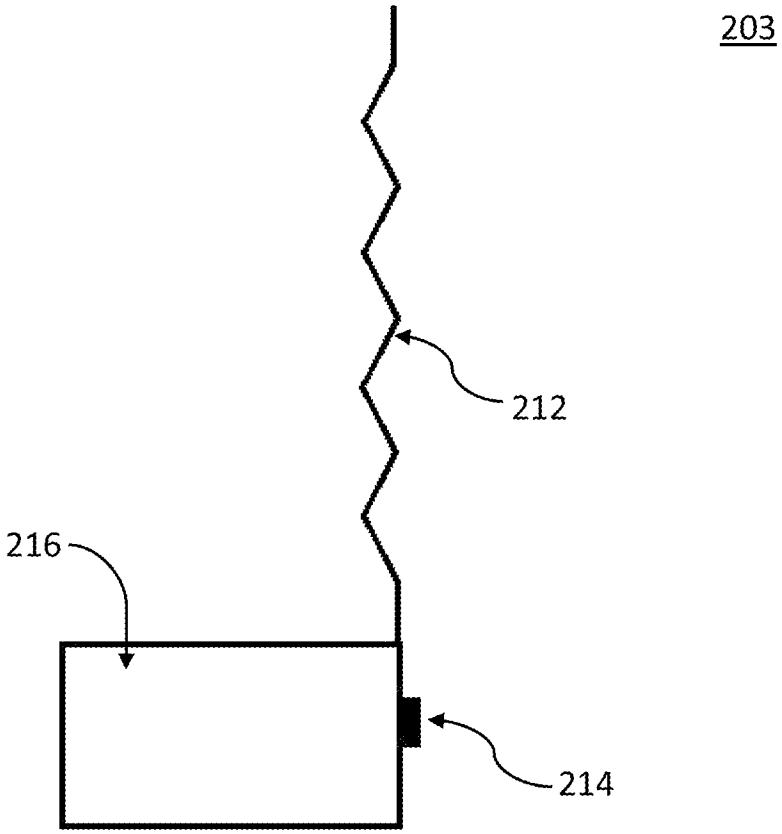
FIG. 2D is a side perspective view of an internal food holding component of the system shown in FIG. 2A, in accordance with an embodiment of the present invention.

Referring now to FIG. 2D, with continued reference to FIGS. 2A-2C, a side perspective view of an internal food holding component 203 of the system 200 shown in FIG. 2A is illustratively depicted in accordance with an embodiment of the present invention. In one embodiment, the internal food holding component 203 can include a food product holder 216. The food product holder 216 is configured to fit snugly within the bottom portion 202 while allowing sufficient clearance between the exterior sides of the food product holder 216 and the interior walls of the bottom portion 202 to enable easy raising of the food product holder 216 using the handle mechanism 214. The internal food holding component may also include a barrier 212 (e.g., plastic film, accordion-like paper/plastic/rubber, etc.) may be affixed to an upper portion of the interior side of one or more side walls of the bottom portion 202 such that when a handle mechanism 214 (e.g., plastic/paper semi-rigid protrusion, hook, block-like slider, etc.) is raised vertically with respect to the base of the bottom portion 202, a food product holder 216, a barrier 212, and any food product in the food product holder 216 is also raised to provide easy access to the food product throughout consumption by a user, in accordance with various embodiments of the present invention. The barrier 212 prevents any food product from leaking/spilling through the cutout/slit (shown in FIG. 2A) during consumption of the food product by a user in accordance with various embodiments.

Figure 3A:
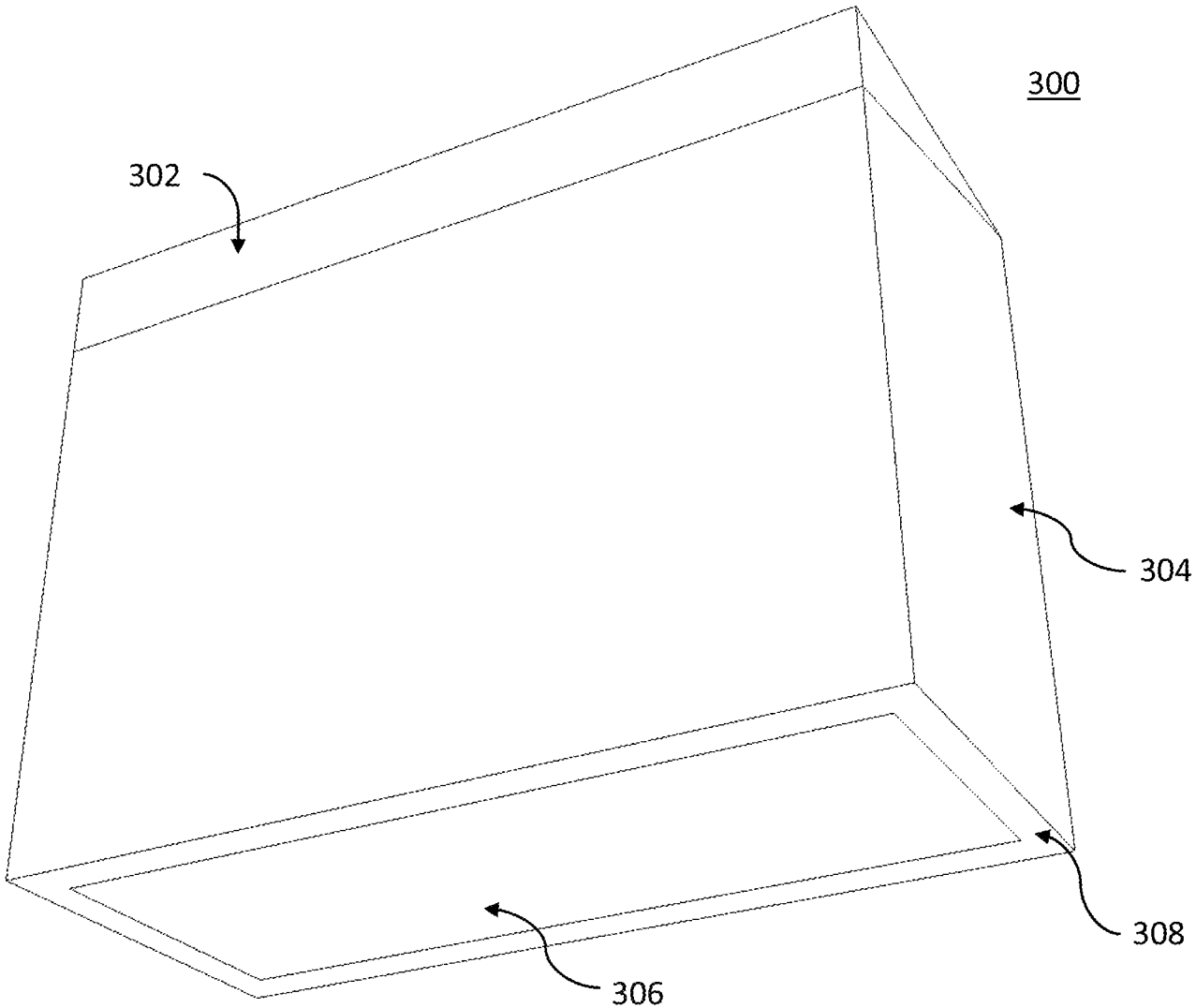
FIG. 3A is a perspective view showing components of a food serving system, in accordance with an embodiment of the present invention.
Figure 3B:
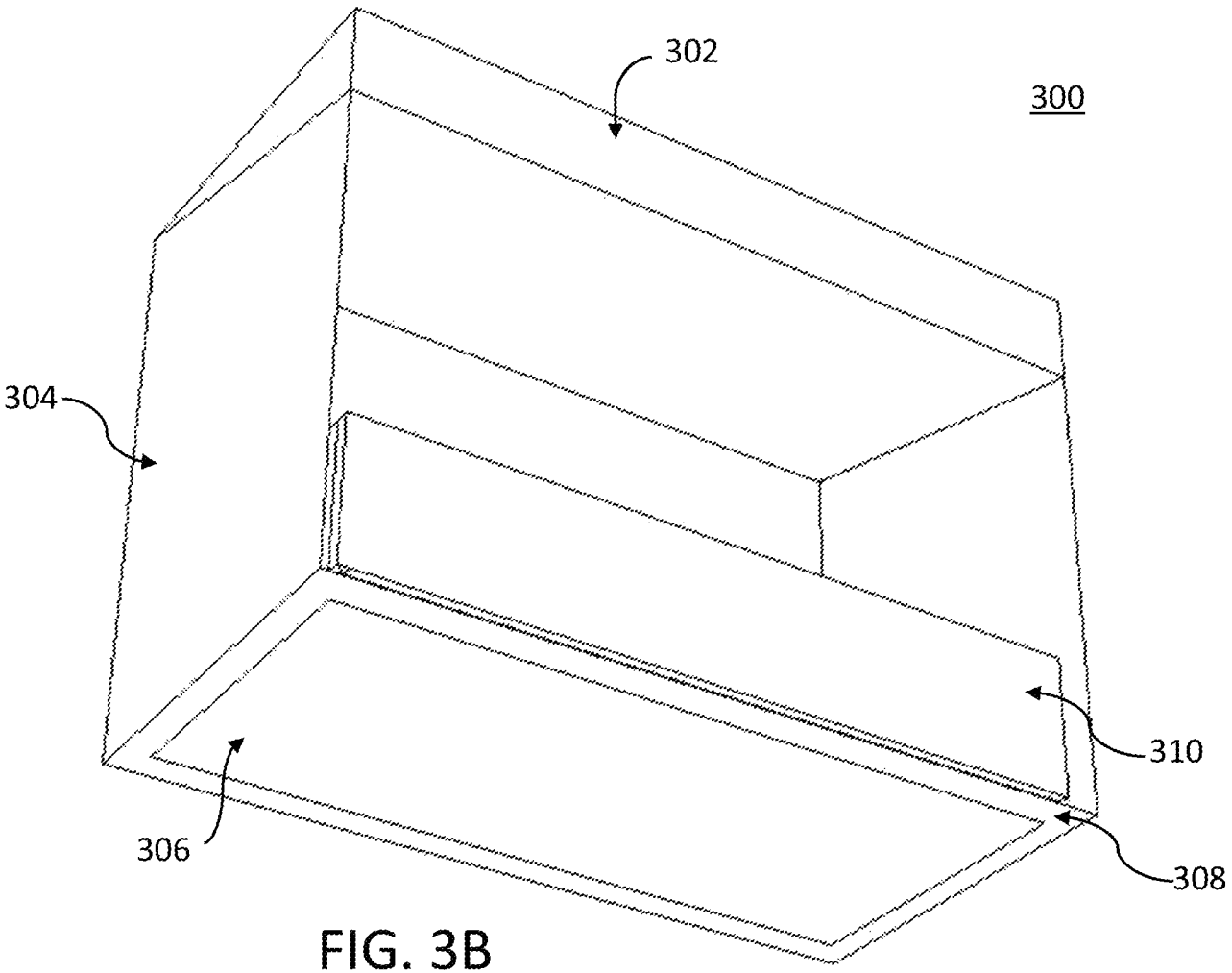
FIG. 3B is a cross-sectional side perspective view of components of the system shown in FIG. 3A, in accordance with an embodiment of the present invention.

Referring now to FIGS. 3A and 3B of the drawings, in which like numerals represent the same or similar elements, and initially to FIG. 3A, a perspective view showing components of a food storing/serving system 300 is illustratively depicted in accordance with an embodiment of the present invention. Components of the food storing/serving system 300 can be fabricated from any material suitable for packaging or serving food, including, for example, paper, cardboard, plastics, metals, polymers, ceramics, semi-rigid/rigid materials, rubbers, silicone, Styrofoam, etc., as readily understood by one of ordinary skill in the art. For example, in some embodiments, the components of the food storing/serving system 300, individually or collectively, can be fabricated from materials such as semi-rigid paper with plastic pivot point bolts/dowels/connectors, which will be described in further detail hereinbelow. In some embodiments of the present invention, the components of the food storing/serving system 300 can be configured to be, for example, disposable (e.g., a paper, cardboard, Styrofoam, etc. fast food-type container), or non-disposable (e.g., a plastic, metal, rubber, etc. travel sandwich container). Of course, in accordance with various embodiments, the food storing/serving system 300 may also include other elements (not shown), and may be formed from any suitable materials, as readily contemplated by one of skill in the art, as well as omit certain elements.

In one embodiment, the food storing/serving system 300 is a hollow, box-like container suitable for storing/carrying a food item (e.g., sandwich, hamburger, etc.). The system 300 can include an open-top box-like bottom portion 304 configured for receiving a food item, and may include a hingedly connected top portion 302, or an open-bottom box-like top portion (not shown) configured to snugly fit onto the bottom portion 304, in accordance with various embodiments of the present invention. The top portion 302 may be detachable, and may be used as a holder for sides (e.g., french fries, sliced fruit, etc.), condiments (e.g., dipping sauces, ketchup, etc.) in accordance with various embodiments of the present invention. The bottom portion 304 of the system 300 can include a ridge 308 forming a cutout/hole 306. A ridge 308 is configured to support a food product holder 310 (shown in FIG. 3B) such that a user may push the food product holder 310 (shown in FIG. 3B) upwards to raise a food product inside the system 300 using, for example, a finger pushing the food product holder 310 (shown in FIG. 3B) through the cutout/hole 306 formed by the ridge 308 in accordance with various embodiments of the present principles.

Referring now to FIG. 3B, with continued reference to FIG. 3A, a cross-sectional side perspective view of components 301 of the system 300 shown in FIG. 3A is illustratively depicted in accordance with an embodiment of the present invention.

In one embodiment, the food storing/serving system 300 is a hollow, box-like container suitable for storing/carrying a food item (e.g., sandwich, hamburger, etc.). The system 300 can include an open-top box-like bottom portion 304 configured for receiving a food item, and may include a hingedly connected top portion 302, or an open-bottom box-like top portion (not shown) configured to snugly fit onto the bottom portion 304, in accordance with various embodiments of the present invention. The top portion 302 may be detachable, and may be used as a holder for sides (e.g., french fries, sliced fruit, etc.), condiments (e.g., dipping sauces, ketchup, etc.) in accordance with various embodiments of the present invention. The bottom portion of the system 300 can include a ridge 308 forming a cutout/hole 306, and the ridge 308 is configured to support a food product holder 310 such that a user may push the food product holder 310 upwards to raise a food product inside the system 300 using, for example, a finger pushing the food product holder 310 through the cutout/hole 306 formed by the ridge 308 in accordance with various embodiments of the present invention.

Figure 4A:
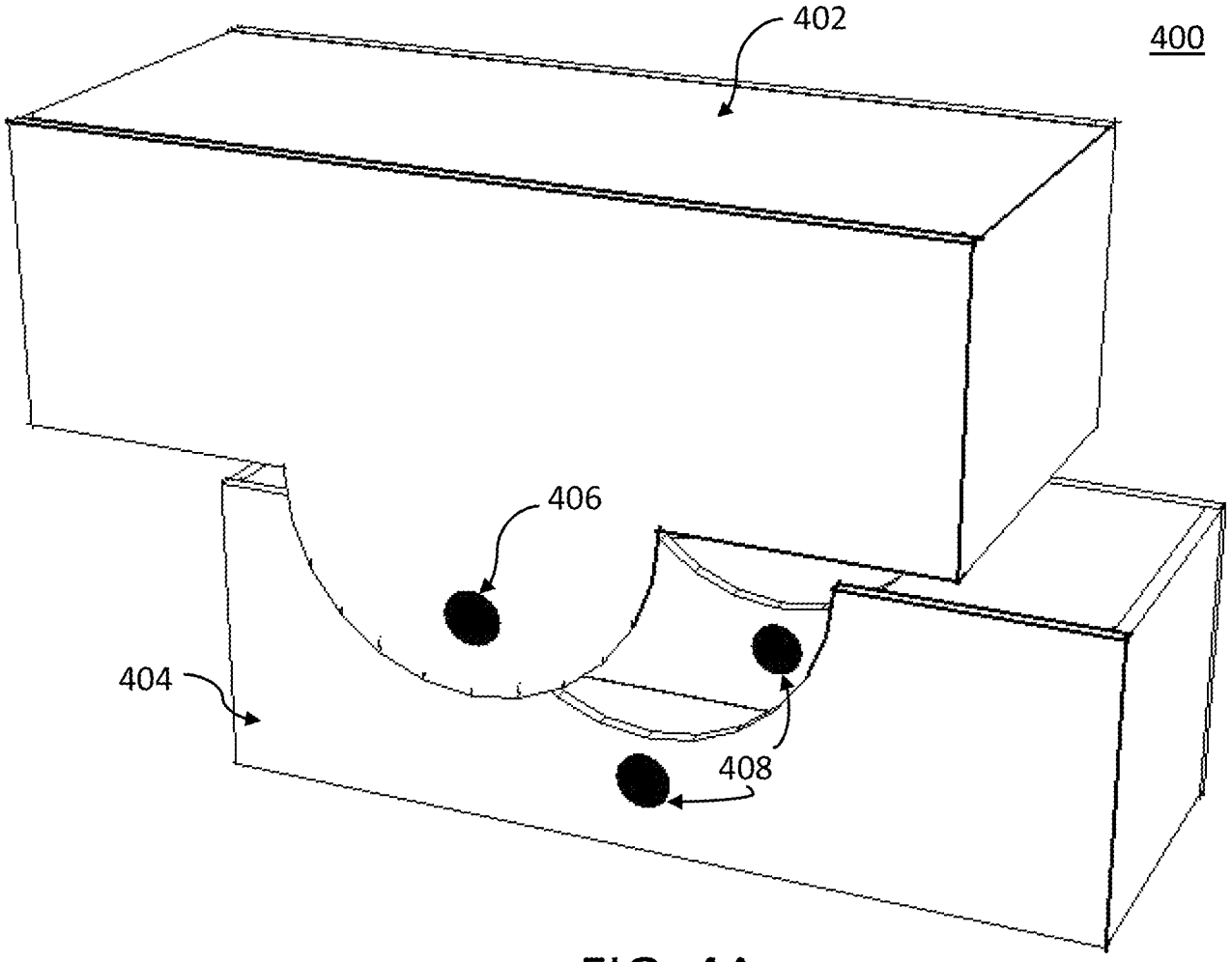
FIG. 4A is a perspective view showing components of a food serving system, in accordance with an embodiment of the present invention.

Referring now to FIGS. 4A-4D of the drawings, in which like numerals represent the same or similar elements, and initially to FIG. 4A, a perspective view showing components of a food storing/serving system 400 is illustratively depicted in accordance with an embodiment of the present invention.

The components of the food storing/serving system 400 can be fabricated from any material suitable for packaging or serving food, including, for example, paper, cardboard, plastics, metals, polymers, ceramics, semi-rigid/rigid materials, rubbers, silicone, Styrofoam, etc., as readily understood by one of ordinary skill in the art. In some embodiments of the present invention, the components of the food storing/serving system 400 can be configured to be, for example, disposable (e.g., paper, cardboard, Styrofoam, etc. fast food-type container), or non-disposable (e.g., plastic, metal, rubber, etc. travel sandwich container). Of course, in accordance with various embodiments, the food storing/serving system 400 may also include other elements (not shown), and may be formed from any suitable materials, as readily contemplated by one of skill in the art, as well as omit certain elements.

In one embodiment, the food storing/serving system 400 is a hollow, box-like container suitable for storing/carrying a food item (e.g., sandwich, hamburger, etc.). The system 400 can include an open-top box-like bottom portion 404 configured for receiving a food item. In some embodiments, the bottom portion 404 can include semi-circular cutouts on two opposing sides of the bottom portion 404. The bottom portion 404 may be formed from two portions, Side A 410, Side B 420 (shown in FIG. 4C), and pivotally fastened together at pivot points/joints 408 on two opposing sides of the bottom portion 404. The pivot points/joints 408 may be constructed from any appropriate material (e.g., metal, plastic, paper, etc.), and may be formed from any appropriate type of pivoting connector (e.g., plastic snap connector, barrel nut, connector bolt, magnetic connectors, etc.).

In one embodiment, the system 400 can include an open-bottom box-like top portion 402, having a cavity configured for receiving a food item, and the top portion 402 can include semi-circular flap-like portions which extend over the bottom portion 404 when the system is in a closed state (e.g., top portion 402 placed securely onto bottom portion 404). In some embodiments, the top portion 402 can include a mechanism 406 for closure of the container system 400 during storage/transport. The mechanism 406 may be, for example, a snap-type closure which snaps onto a portion of the pivot points/joints 408, a magnetic closure which attaches to the pivot points/joints 408, or any suitable closure mechanism, as readily appreciated by those of ordinary skill in the art. The top portion 402 may be detachable, and may be used as a holder for sides (e.g., french fries, sliced fruit, etc.), condiments (e.g., dipping sauces, ketchup, etc.) in accordance with various embodiments of the present invention.

Figure 4B:
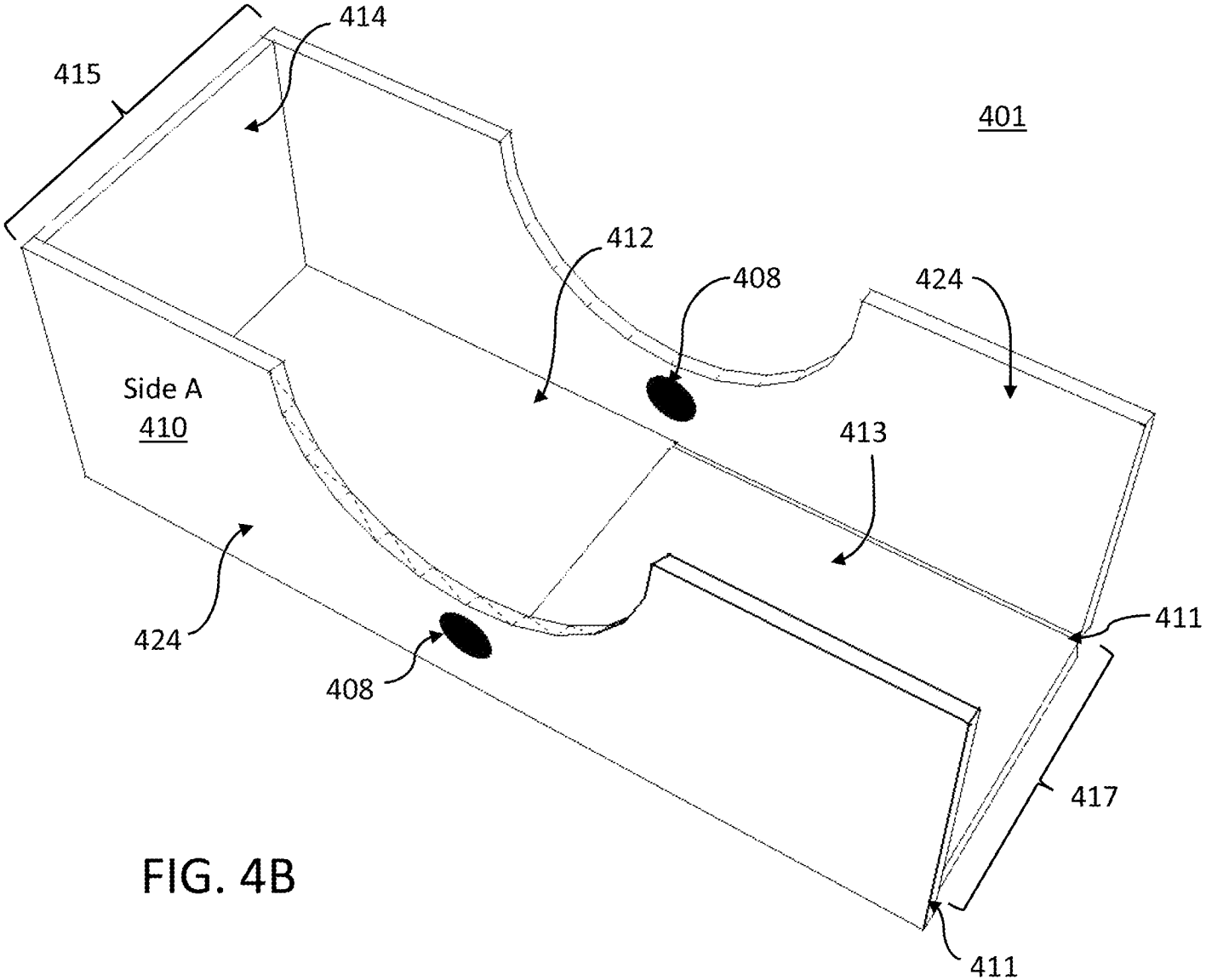
FIG. 4B is a top perspective view of a separated section of a bottom portion of the system shown in FIG. 4A, in accordance with an embodiment of the present invention.

Referring now to FIG. 4B, with continued reference to FIG. 4A, a top perspective view of a separated section 401 of a bottom portion of the system 400 shown in FIG. 4A is illustratively depicted in accordance with an embodiment of the present invention.

Figure 4C:
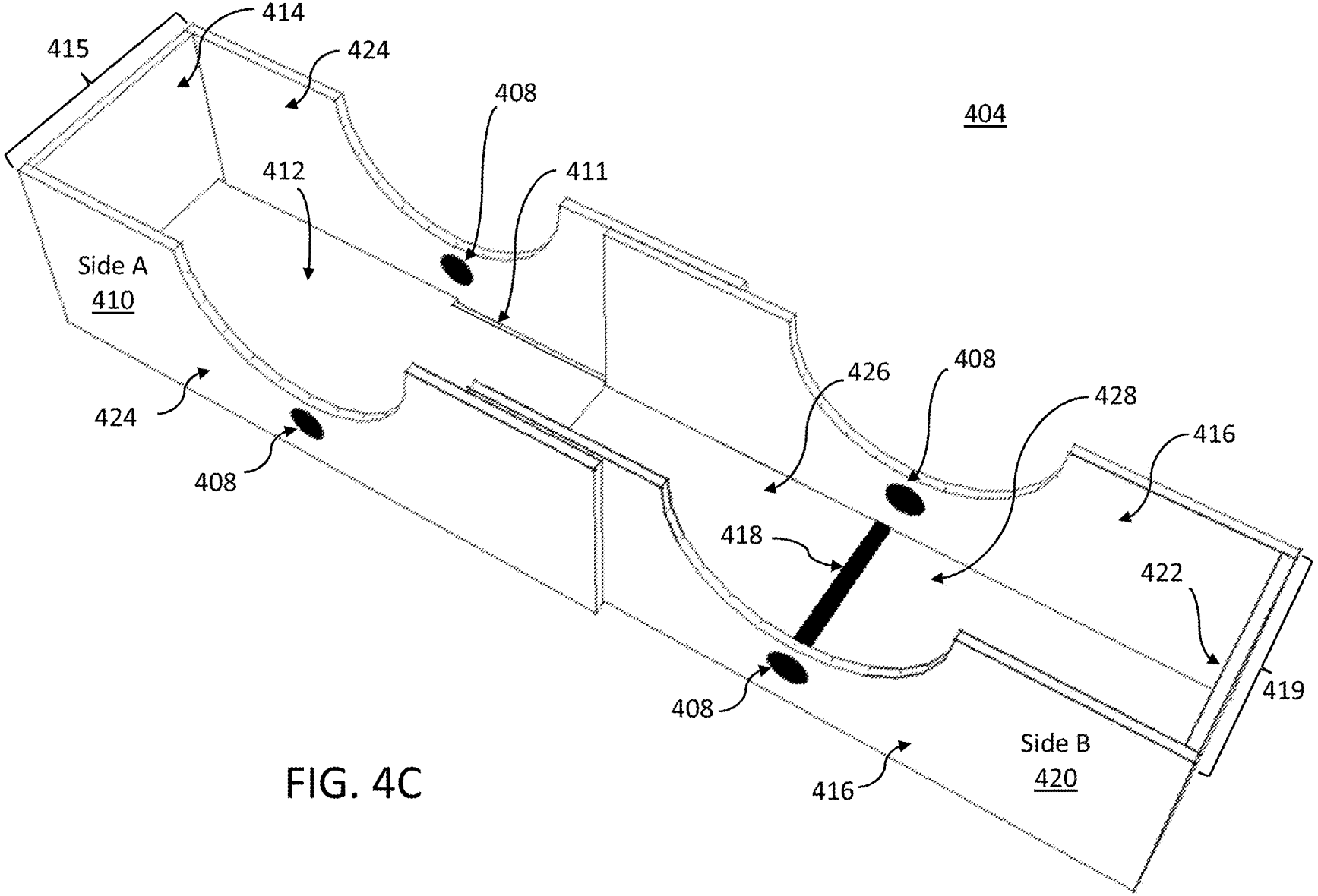
FIG. 4C is a top perspective view of components of a bottom portion of the system shown in FIG. 4A, with parts separated, in accordance with an embodiment of the present invention.

In one embodiment, the bottom portion of the system 400 is formed from two portions, Side A 410 and Side B 420 (shown in FIG. 4C). Side A 410 is formed as an open top box-like structure including an end wall portion 414, two side wall portions 424, base portions 412, 413, and pivot points/joints 408 configured for pivotally fastening Side A 410 to Side B 420 (shown in FIG. 4C) on opposing sides of the side wall portions 408 of Side A 410.

In one embodiment, the base portion 412 extends laterally to approximately the mid-point of the length of the side wall portions 424, or approximately the mid-point of the openings 408, and base portion 413 extends laterally from the end of the base portion 412 to a combined length equal to, or less than a length of the side wall portions 424. The base portion 413 is separated from the side wall portions 424 by slits/cutouts 411 on opposing sides of the base portion 413, such that the width 417 of the base portion 413 is smaller than the width 415 of base portion 412. The base portions 412, 413 are described as two distinct parts herein for illustrative purposes, but it is to be appreciated that the base portions 412, 413 may be constructed as a single piece in accordance with various embodiments of the present principles.

Referring now to FIG. 4C, with continued reference to FIGS. 4A and 4B, a top perspective view of components of a bottom portion 404 of the system 400 shown in FIG. 4A, with parts separated, is illustratively depicted in accordance with an embodiment of the present invention.

In one embodiment, the bottom portion 404 of the system 400 is formed from two portions, Side A 410 and Side B 420. Side A 410 is formed as an open top box-like structure including an end wall portion 414, two side wall portions 424, a base portion 412, a flap-like platform 413, slit/cutout portions 411 on opposing sides of the flap-like platform 413, and pivot points/joints 408 configured for pivotally fastening Side A 410 to Side B 420 on opposing sides of the side wall portions 424 of Side A 410. The base portion 412 and/or the flap-like platform 413 may include a support structure (i.e., hard plastic, cardboard, metal, etc.), on the underside, top, and/or sides of the base portion 412 and/or the flap-like platform 413 to provide further support for the flap-like platform 413 which can include the slits/cutouts 411 in accordance with various embodiments of the present invention.

In one embodiment, base portion 412 extends laterally to approximately the mid-point of the length of the side wall portions 424 while being directly attached to the side wall portions 424, and the flap-like platform 413 is separated from the side wall portions 424 by slits/cutouts 411 beginning at approximately the mid-point of the pivot points/joints 408 on opposing sides of the side wall portions 424, and is separated from the side wall portions 424 for the length of the flap-like platform 413. The combination of the base portion 412 and the flap-like platform 413 extends laterally to a length equal to, or less than the length of the side wall portions 424, in accordance with various embodiments of the present invention.

In one embodiment, Side B 420 is formed as an open top box-like structure including an end wall portion 422, two side wall portions 416, two base portions 426, 428, a slit/cutout 418 positioned between the two base portions 426, 428, and pivot points/joints 408 configured for pivotally fastening Side B 420 to Side A 410 on opposing sides of the bottom portion 404. The base portions 422, 426, and the slit/cutout 418 extend laterally to a combined length equal to, or less than the length of the side wall portions 416, and the slit/cutout 418 is configured such that the flap-like platform 413 is separated from the side wall portions 424 in accordance with various embodiments of the present invention. The side wall portions 416 of Side B 420 are configured to fit snugly inside the side wall portions 424 of Side A 410 (e.g., Side B 420 width 419 is smaller than Side A 410 width 1522) while allowing sufficient space to prevent excessive rubbing of the side wall portions 424, 416 against each other while pivoting Side A 410 and Side B 420 during use in accordance with an embodiment of the present invention.

Figure 4D:
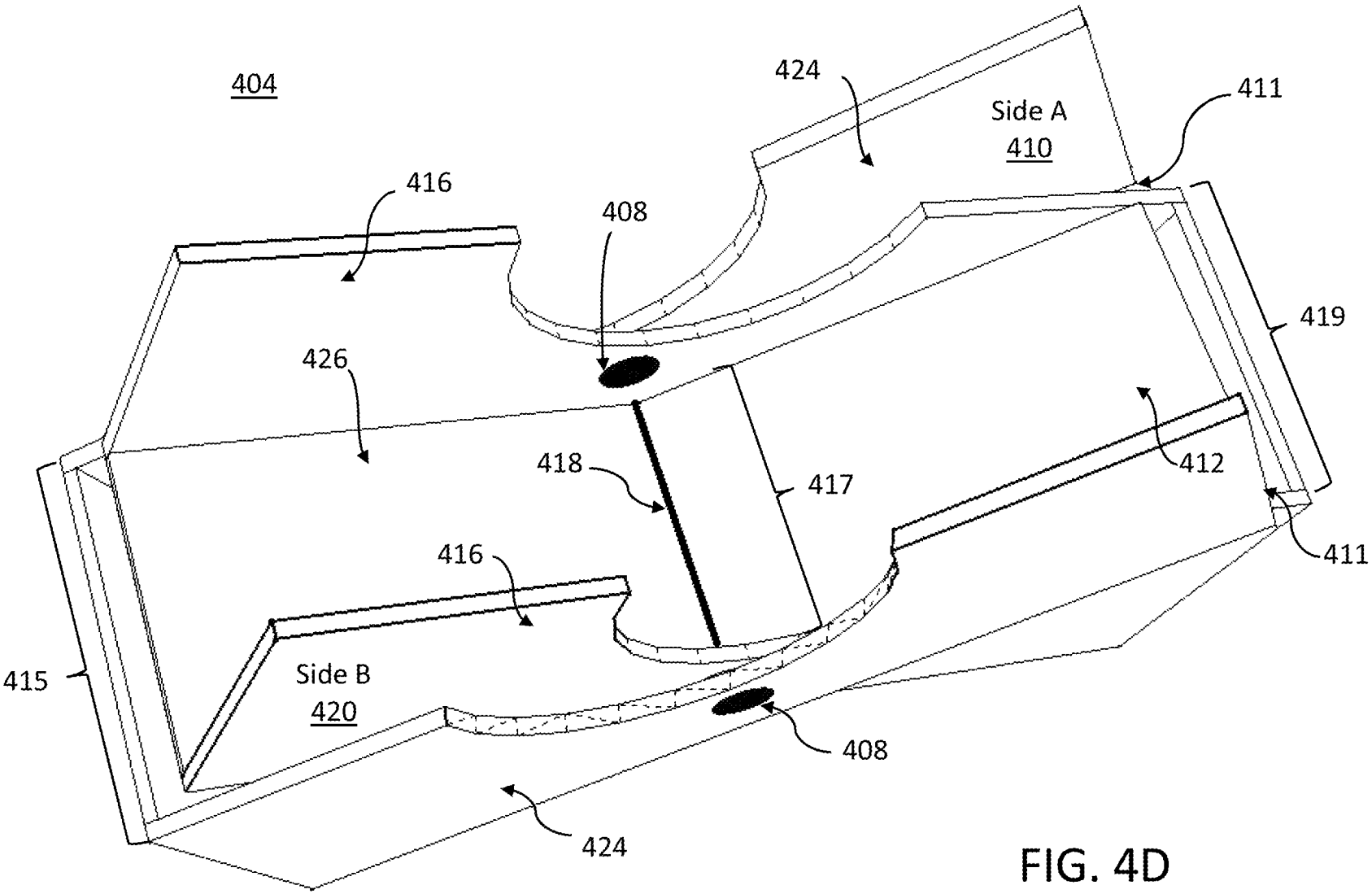
FIG. 4D is a top perspective view of components of a bottom portion of the system shown in FIG. 4A, in accordance with an embodiment of the present invention.

Referring now to FIG. 4D, with continued reference to FIGS. 4A-4C, a perspective view of components of a bottom portion 404 of the system 400 shown in FIG. 4A is illustratively depicted in accordance with an embodiment of the present invention.

In one embodiment, Side A 410 and Side B 420 are configured to be pivotally fastened to each other at pivot points/joints 408 positioned on the side wall portions 424 of Side A 410 and the side wall portions 416 of Side B 420. The side wall portions 416 of Side B 420 are configured to fit snugly inside the side walls 424 of Side A 410 (e.g., Side B 420 width 419 is smaller than Side A 410 width 415) while allowing sufficient space to prevent excessive rubbing of the side walls 424, 416 against each other while pivoting Side A 410 and Side B 420 during use.

In one embodiment, the flap-like platform 413 of Side A 410 is separated from the side wall portions 424 of Side A 410 at approximately the mid-point of the length of the side wall portions 424, forming a semi-rigid/rigid flap-like platform 413, which is positioned such that the flap-like platform 413 extends through a slit/cutout 418 positioned at or near the mid-point of the base portion 426 of Side B 420. The slit/cutout 418 is sufficiently large to allow the flap-like platform 413 to snugly fit through the slit/cutout 418 while allowing a sufficient range of motion for pivoting Side A 410 and Side B 420 when using the bottom portion 404 during consumption of a food product, in accordance with various embodiments of the present principles. The base portion 412 of Side A 410 has a width 417 of less than the width 415 of Side B 420 such that sufficient space is provided to prevent excessive rubbing of the side walls 416 of Side B 420 against the base portion 412 while pivoting Side A 410 and Side B 420 during use of the system 400. In some embodiments, the base portions 412, 426, and/or the flap-like platform 413 may include a support structure (i.e., hard plastic, cardboard, metal, etc.), on the underside, top, and/or sides of the base portions 412, 426, and/or the flap-like platform 413 to provide further support for supporting the food product, in accordance with various embodiments of the present invention In one embodiment, Side A 410 and Side B 420 of the bottom portion 404 are pivotally connected at pivot points/joints 408, and are configured to be pivoted such that a food product (e.g., sandwich) is raised by the resulting movement of the base portions 412, 426, and the flap-like platform 413 during consumption of the food product by a user. The bottom portion 404 is configured for receiving and holding a food product on the base portions 412, 426, and/or the flap-like platform 413. The bottom portion 404 is configured such that by holding Side A 410 and Side B 420 in the hands of a user, and pivoting Side A 410 and Side B 420 away from each other in a downward motion about the pivot points/joints 408, the food product is elevated by the exposed base portions 426 and the flap-like platform 413, relative to the bottom of the base portion 404, to provide easy access to the food product throughout consumption by a user, in accordance with various embodiments of the present invention.

Figure 5A:
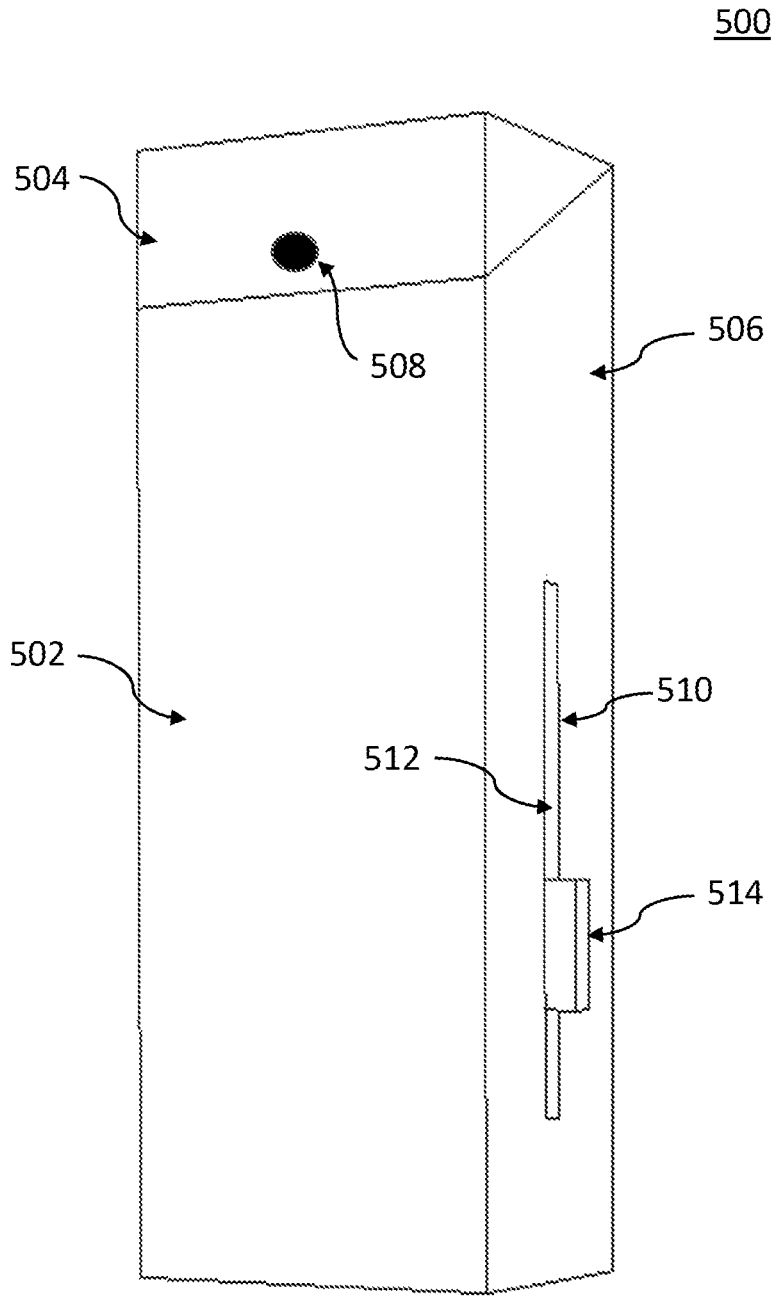
FIG. 5A is a perspective view showing components of a food serving system, in accordance with an embodiment of the present invention.

Referring now to FIGS. 5A-5D of the drawings, in which like numerals represent the same or similar elements, and initially to FIG. 5A, a perspective view showing one embodiment of components of a food storing/serving system 500 is illustratively depicted in accordance with an embodiment of the present invention.

The components of the food storing/serving system 500 can be fabricated from any material suitable for packaging or serving food, including, for example, paper, cardboard, plastics, metals, polymers, ceramics, semi-rigid/rigid materials, rubbers, silicone, Styrofoam, etc., as readily understood by one of ordinary skill in the art. In accordance with various embodiments of the present invention, some or all components of the food storing/serving system 100 can be configured to be disposable (e.g., a paper, cardboard, Styrofoam, etc. fast food-type container), or non-disposable (e.g., a plastic, metal, rubber, etc. travel sandwich container). In some embodiments, the system 500 may be a substantially rectangular, elongated box-like structure suitable for storing/serving, for example, hot dogs, hero-type sandwiches, cheesesteak sandwiches, etc.). Of course, in accordance with various embodiments, the food storing/serving system 500 may also can include other elements (not shown), and may be formed from any suitable materials, as readily contemplated by one of skill in the art, as well as omit certain elements.

In one embodiment, the food storing/serving system 500 is a hollow, box-like container suitable for storing/carrying a food item (e.g., hot dog, hero sandwich, cheesesteak sandwich, etc.). The system 500 can include an open-top box-like bottom portion 502 configured for receiving a food item, and may include a hingedly connected top portion 504 or an open-bottom box-like top portion (not shown) configured to snugly fit onto the bottom portion 502 in accordance with various embodiments of the present invention. In some embodiments, the top portion 504 can include a mechanism 508 for closure of the container system 500 during storage/transport. The mechanism 508 may be, for example, a snap-type closure which snaps onto a corresponding connector on the bottom portion 502, a magnetic closure, or any suitable closure mechanism, as readily appreciated by those of ordinary skill in the art. The top portion 504 may be detachable, and may be used as a holder for sides (e.g., french fries, sliced fruit, etc.), condiments (e.g., dipping sauces, ketchup, etc.) in accordance with various embodiments of the present invention.

In one embodiment, one of the side wall portions 506 of the bottom portion 502 may include a slit/cutout 510, which may be positioned at or near the midpoint of the width of the side wall portion 506 of the bottom portion 502. The cutout/slit 510 may extend vertically/longitudinally on the side wall portion 506 from the base of the side wall portion 506 to the top of the side wall portion 506, or in any of a plurality of substantially vertical lengths, in accordance with various embodiments. A barrier 512 (e.g., plastic film, accordion-like paper/plastic/rubber, etc.) may be affixed to an upper portion of the interior side of the side wall portion 506 such that when a handle mechanism 514 (e.g., a plastic/paper semi-rigid protrusion, hook, block-like slider, etc.) is raised vertically with respect to the base of the bottom portion 502, an attached food product holder (shown in FIG. 5B), the barrier 512, and any food product in the food product holder (shown in FIG. 5B) is also raised to provide easy access to the food product throughout consumption by a user, in accordance with various embodiments of the present invention. In some embodiments, the food product holder (shown in FIG. 5B) is substantially flat, while in other embodiments, the food holder is an open top box-like structure, in accordance with the present principles. The barrier 512 prevents any food product from leaking/spilling through the cutout/slit 510 during consumption. In some embodiments, a cutout/slit 510, a barrier 512, and two handle mechanisms 514 may be positioned on two opposing side portions 506, and two handle mechanisms 514 may function cooperatively to lift the food product vertically during use of the system 500, which is described in further detail herein below with reference to FIG. 5C in accordance with various embodiments of the present invention.

Figure 5B:
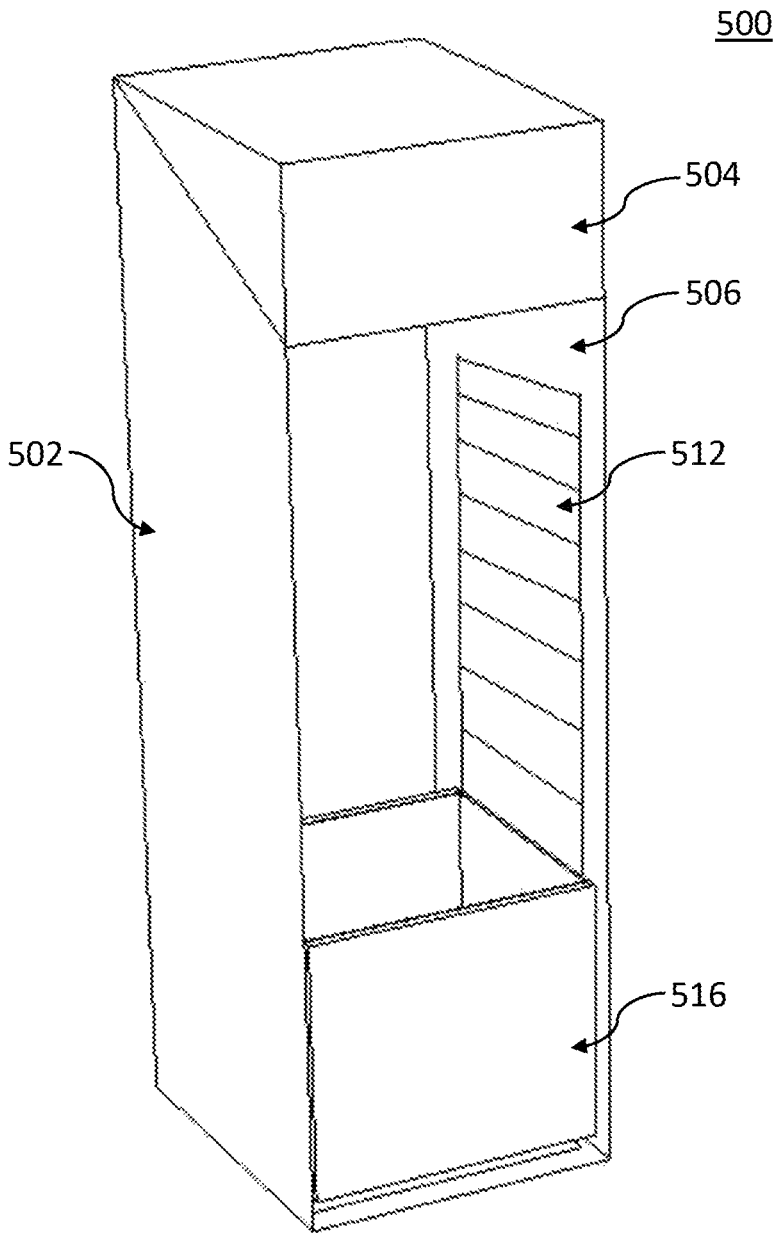
FIG. 5B is a cross-sectional side perspective view of components of the system shown in FIG. 5A, in accordance with an embodiment of the present invention.

Referring now to FIG. 5B, with continued reference to FIG. 5A, a cross-sectional side perspective view of components of the system 500 shown in FIG. 5A is illustratively depicted in accordance with an embodiment of the present invention. In one embodiment, the food storing/serving system 500 is a hollow, box-like container suitable for storing/carrying a food item (e.g., sandwich, hamburger, etc.). The system 500 can include an open-top box-like bottom portion 502 configured for receiving a food item, and may include a hingedly connected top portion 504 or an open-bottom box-like top portion (not shown) configured to snugly fit onto the top portion in accordance with various embodiments of the present invention. In some embodiments, the top portion 504 may be detachable, and may be used as a holder for sides (e.g., french fries, sliced fruit, etc.), condiments (e.g., dipping sauces, ketchup, etc.).

In one embodiment, one of the side wall portions 506 of the bottom portion 502 may include a slit/cutout 510 (shown in FIG. 5A), which may be positioned at or near the midpoint of the width of one of the side wall portions 506 of the bottom portion 502. The cutout/slit 510 (shown in FIG. 5A) may extend vertically on the side wall portion 506 from the base of the side wall portion 506 to the top of the side wall portion 506, or in any of a plurality of substantially vertical lengths, in accordance with various embodiments. A barrier 512 (e.g., plastic film, accordion-like paper/plastic/rubber, etc.) may be affixed to an upper portion of the interior side of the side wall portion 506 and to a food product holder 516 such that when a handle mechanism 514 (shown in FIG. 5A) (e.g., plastic/paper semi-rigid protrusion, hook, block-like slider, etc.) is raised vertically with respect to the base of the bottom portion 502, a food product holder 516 (e.g., flat surface, open top box-like structure, etc) and any food product in the food product holder 516 is also raised to provide easy access to the food product throughout consumption by a user, in accordance with various embodiments of the present invention. The food product holder may be attached to the handle 514 (shown in FIG. 5A) and/or the barrier 512, in accordance with various embodiments of the present invention. The barrier 512 prevents any food product from leaking/spilling through the slit/cutout 510 (shown in FIG. 5A) during consumption.

In some embodiments, two slits/cutouts 510 (shown in FIG. 5A), 522 (shown in FIG. 5C), two barriers 512, 518 (shown in FIG. 5C), and two handle mechanisms/sliders 514 (shown in FIG. 5A), 524 (shown in FIG. 5C) may be positioned on two opposing side portions 506, and may function cooperatively to lift the food product vertically during use of the system 500. The handle mechanism may be formed in any suitable shape and of any suitable material for attaching to the food product holder 516 and raising the food product holder 516 and the food product during consumption by a user in accordance with various embodiments of the present invention, which will be described in further detail herein below with reference to FIG. 5C.

Figure 5C:
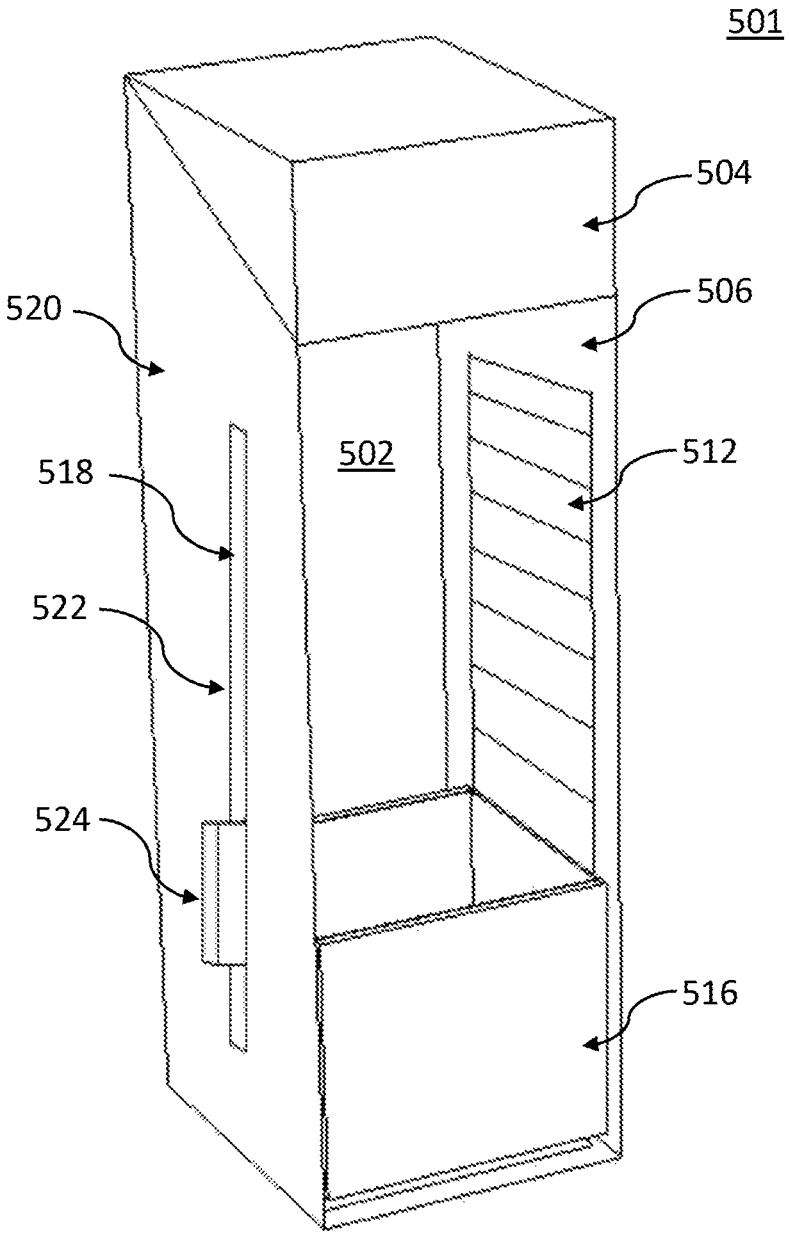
FIG. 5C is a cross-sectional bottom perspective view of components of the system shown in FIG. 5A, in accordance with an embodiment of the present invention.

Referring now to FIG. 5C, with continued reference to FIGS. 5A and 5B, a cross-sectional side perspective view of components 501 of the system 500 shown in FIG. 5A is illustratively depicted in accordance with an embodiment of the present invention. In one embodiment, the food storing/serving system 500 is a hollow, box-like container suitable for storing/carrying a food item (e.g., sandwich, hamburger, etc.). The system 500 can include an open-top box-like bottom portion 502 configured for receiving a food item, and may include a hingedly connected top portion 504 or an open-bottom box-like top portion (not shown) configured to snugly fit onto the top portion in accordance with various embodiments of the present invention. In some embodiments, the top portion 504 may be detachable, and may be used as a holder for sides (e.g., french fries, sliced fruit, etc.), condiments (e.g., dipping sauces, ketchup, etc.).

In one embodiment, opposing side wall portions 520, 506 of the bottom portion 502 each can include a slit/cutout 522, 510 (shown in FIG. 5A) on opposing side wall portions 520, 506 of the bottom portion 502. The slits/cutouts 522, 510 (shown in FIG. 5A) may be positioned at or near the midpoint of the width of the opposing side wall portions 520, 506 of the bottom portion 502. The slits/cutouts 522, 510 (shown in FIG. 5A) may extend vertically on the opposing side wall portions 520, 506 from the base of the opposing side wall portions 520, 506 to the top of the opposing side wall portions 520, 506, or in any of a plurality of substantially vertical lengths, in accordance with various embodiments. Barriers 512, 518 (e.g., plastic film, accordion-like paper/plastic/rubber, etc.) may be affixed to an upper portion of the interior side of the side wall portions 520, 506 such that when handle mechanisms 524, 514 (shown in FIG. 5A) (e.g., plastic/paper semi-rigid protrusion, hook, block-like slider, etc.), which are functionally connected to a food product holder 516, are raised vertically with respect to the base of the bottom portion 502, the food product holder 516 and any food product in the food product holder 516 is also raised to provide easy access to the food product throughout consumption by a user, in accordance with various embodiments of the present invention.

In accordance with various embodiments, the food product holder 516 may be attached to the handle/slider mechanisms 524, 514 (shown in FIG. 5A) and/or the barriers 512, 518, in accordance with the present invention. The barriers 512, 518 prevents any food product from leaking/spilling through the slits/cutouts 522, 510 (shown in FIG. 5A) during consumption. In some embodiments, the slits/cutouts 522, 510 (shown in FIG. 5A), the barriers 512, 518, and the handle mechanisms 524, 514 (shown in FIG. 5A) are positioned on two opposing side wall portions 520, 506 of the base portion 502, and the two handle mechanisms 524, 514 (shown in FIG. 5A) function cooperatively to lift the food product vertically during use of the system 500.

Figure 5D:
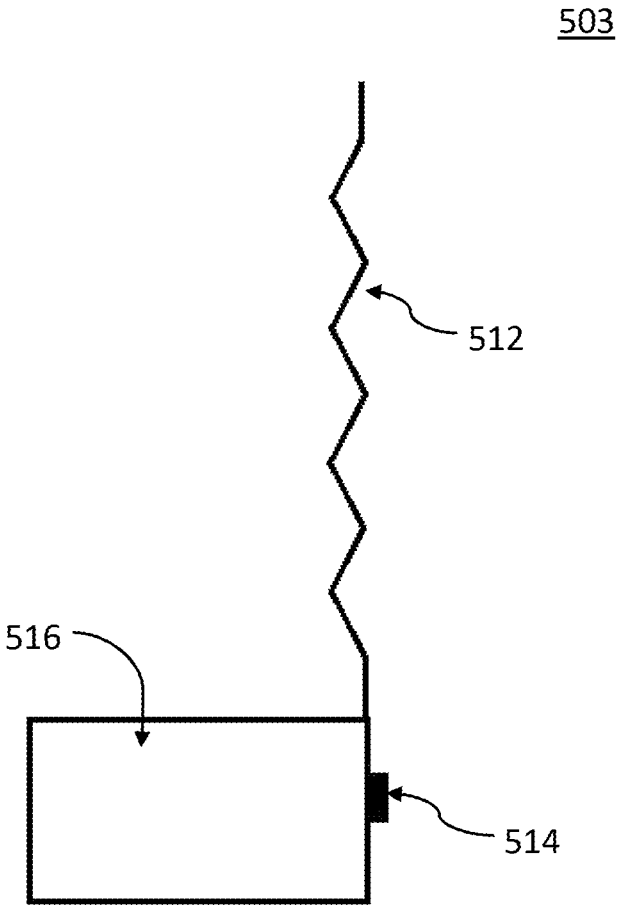
FIG. 5D is a side perspective view of an internal food holding component of the system shown in FIG. 5A, in accordance with an embodiment of the present invention.

Referring now to FIG. 5D, with continued reference to FIGS. 5A-5C, a perspective view of an internal food holding component 503 of the system 500 shown in FIG. 5A is illustratively depicted in accordance with an embodiment of the present invention. In one embodiment, the internal food holding component 503 can include a food product holder 516. The food product holder is configured to fit snugly within the bottom portion 502 while allowing sufficient clearance between the exterior sides of the food product holder 516 and the interior walls of the bottom portion 502 to enable easy raising of the food product holder 516 using the handle mechanism 514. The internal food holding component may also include a barrier 512 (e.g., plastic film, accordion-like paper/plastic/rubber, etc.) may be affixed to an upper portion of the interior side of one or more side walls of the bottom portion 502 (shown in FIG. 5A) such that when a handle mechanism 514 (e.g., plastic/paper semi-rigid protrusion, hook, block-like slider, etc.) is raised vertically with respect to the base of the bottom portion 502, a food product holder 516, a barrier 512, and any food product in the food product holder 516 is also raised in relation to the base of the bottom portion 502 to provide easy access to the food product throughout consumption by a user, in accordance with various embodiments of the present invention. The barrier 512 prevents any food product from leaking/spilling through the cutout/slit 510 (shown in FIG. 5A) during consumption.

Figure 6A:
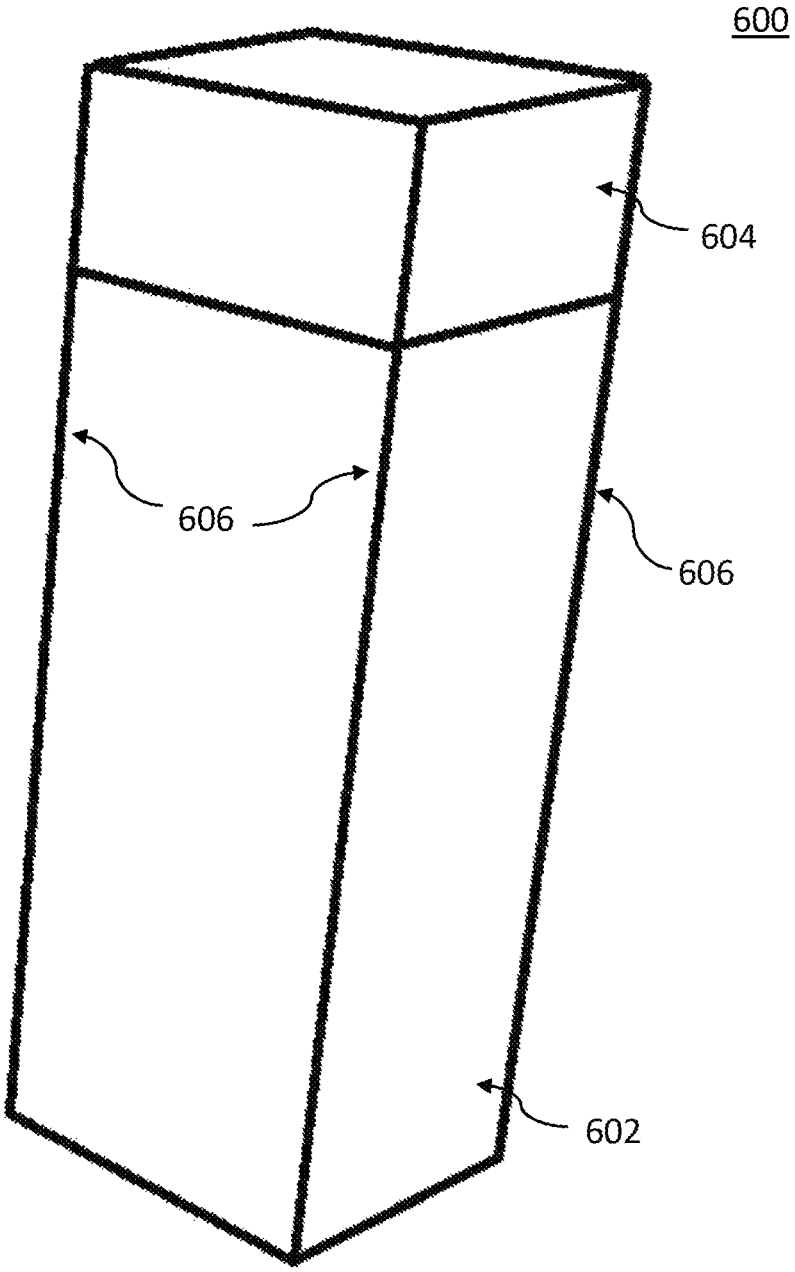
FIG. 6A is a perspective view showing components of a food serving system, in accordance with an embodiment of the present invention.
Figure 6B:
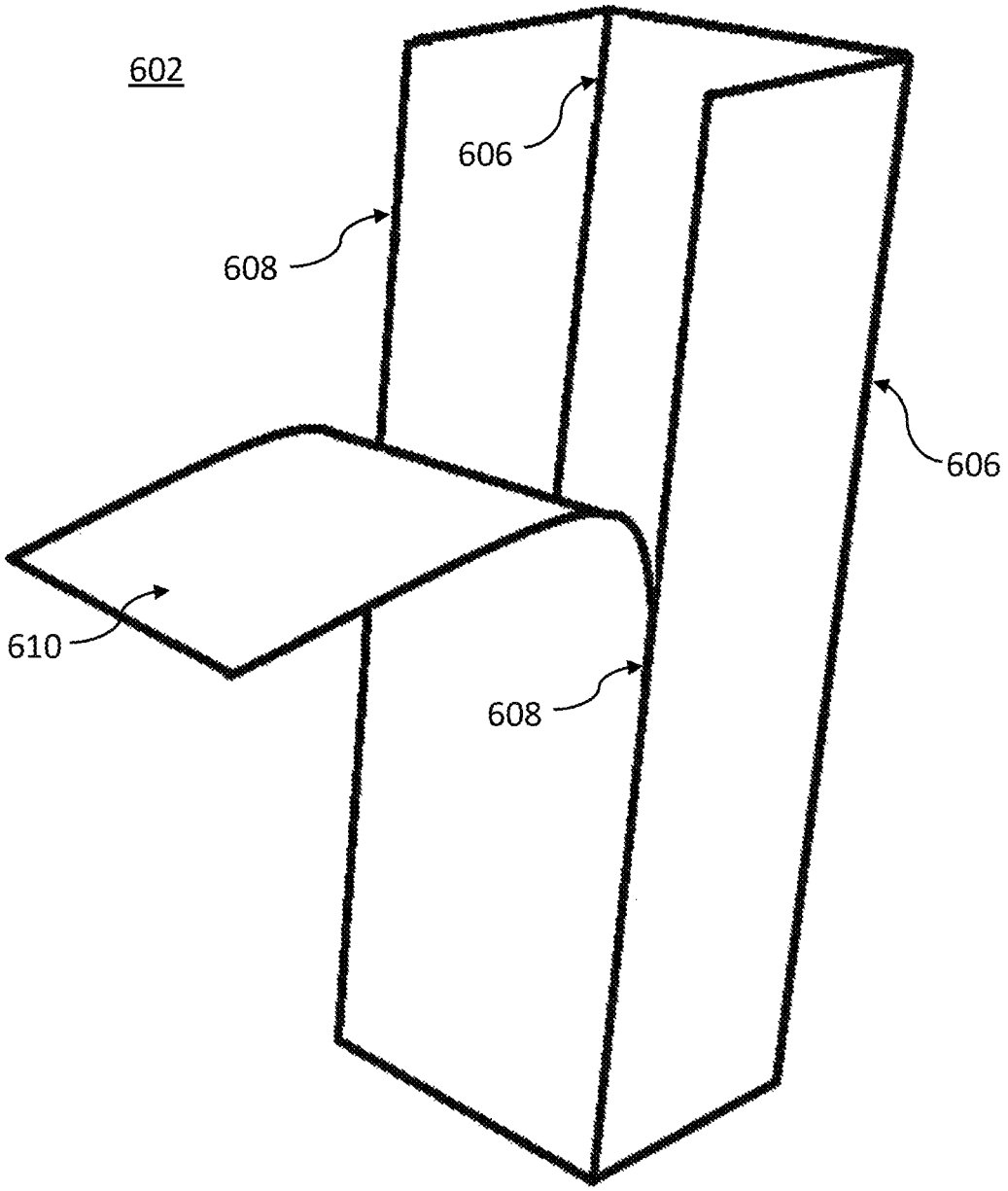
FIG. 6B is a side perspective view of components of the system shown in FIG. 6A, in accordance with an embodiment of the present invention.

Referring now to FIGS. 6A and 6B of the drawings, in which like numerals represent the same or similar elements, and initially to FIG. 6A, a perspective view showing one embodiment of components of a food storing/serving system 600 is illustratively depicted in accordance with an embodiment of the present invention.

In one embodiment, the food storing/serving system 600 is a hollow, box-like container suitable for storing/carrying a food item (e.g., hot dog, hero sandwich, cheesesteak sandwich, etc.). The system 600 can include an open-top box-like bottom portion 602 configured for receiving a food item, and may include an open-bottom box-like top portion 604 configured to snugly fit onto the bottom portion 602 in accordance with various embodiments of the present invention. The bottom portion 602 can include seams 606 along the length of each vertical edge of the bottom portion 602. In accordance with various embodiments, the seams 606 may be configured for being separated permanently (e.g., paper/cardboard tearable seams), or may be configured to be resealable and reusable (e.g., resealable rubber/plastic seams, etc.).

Referring now to FIG. 6B, with continued reference to FIG. 6A, a side perspective view of components 602 of the system 600 shown in FIG. 6A is illustratively depicted in accordance with an embodiment of the present invention. In one embodiment, for illustrative purposes, a bottom portion 602 of the system 600 is shown with two partially separated seams 608 (e.g., in a separated state), which creates one or more flap-like portions 610 and exposes any food product placed in the system 600 for easy consumption. The non-separated seams 606 may be torn/separated by a user to further expose any food product held in the bottom portion 602 of the system 602 in accordance with various embodiments of the present invention.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

Having described preferred embodiments of a system and method (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

The invention claimed is:

1. A system for storing and serving a food product, comprising:
- a bottom portion configured for receiving the food product, the bottom portion comprising:
  - a first side bottom portion, comprising:
    - an open top box structure including a first end wall portion, two first side wall portions, and a first base portion, the first base portion being separated from the side wall portions by a slit on opposing sides of the base portion to form a flap platform, the slit extending laterally from a midpoint of the base portion to an end length of the first side wall portions;
  - a second side bottom portion, comprising:
    - an open top box structure including a second end wall portion, two second side wall portions, and a second base portion including a cutout at a midpoint of the second base portion, the cutout being configured for receiving the flap; and
  - pivot points positioned at a midpoint of the side wall portions of the first side bottom portion and the second side bottom portion for pivotally fastening the first side bottom portion and the second side bottom portion, the bottom portion being further configured to raise or lower the food product by pivoting the end wall portions about the pivot points.

2. The system as recited in claim 1, wherein the bottom portion is configured to raise the food product by pivoting the end wall portions away from each other in a downward motion.

3. The system as recited in claim 1, wherein the bottom portion is configured to lower the food product by pivoting the end wall portions toward each other in an upward motion.

4. The system as recited in claim 1, wherein the bottom portion is formed from one or more of a plurality of semi-rigid materials.

5. The system as recited in claim 1, wherein the bottom portion is formed from a semi-rigid, flat-foldable paper product.

6. The system as recited in claim 5, wherein the platform further comprises a support structure configured to prevent distortion of the platform during the raising or lowering of the food product.

7. The system as recited in claim 1, further comprising a top portion configured to securely attach to the bottom portion to fully enclose the food product.

8. The system as recited in claim 1, wherein the system is configured to be washable and reusable.

9. A system for storing and serving a food product, comprising:

an open top box bottom portion configured for receiving the food product, the bottom portion comprising four side walls and a bottom wall, and having a substantially rectangular side cutout extending longitudinally on a first side wall, the bottom wall having a bottom cutout forming a ledge along a bottom edge of the four side walls;

an insert positioned inside the bottom portion, the insert comprising:

a base portion configured for supporting the food product;

a handle attached to the base portion, the handle protruding outwardly through the cutout, and being configured to change a position of the base portion relative to the bottom portion by sliding the handle along the cutout, wherein the insert is further configured to be pushed toward the open top of the bottom portion through the bottom cutout.

10. The system as recited in claim 9, wherein the base portion is an open top box structure comprising four side walls and an end wall, wherein a diameter of the base portion end wall is smaller than a diameter of the bottom portion end wall.

11. The system as recited in claim 9, further comprising:

a second cutout on an opposing side wall from the first side wall;

a second handle attached to the base portion, the second handle being positioned on an opposing side of the base portion from the handle, and being configured to cooperatively function with the handle to change a position of the base portion relative to the bottom portion by sliding the handle and the second handle in unison along the cutout.

12. The system as recited in claim 9, further comprising a barrier positioned inside the bottom portion and extending over the cutout along an interior of the first side wall, the barrier being configured to prevent contact between the food product and the cutout.

13. The system as recited in claim 9, wherein the bottom portion is substantially shaped as a rectangular prism.

14. The system as recited in claim 9, wherein the bottom portion is configured to receive a substantially cylindrical food product.

15. The system as recited in claim 9, further comprising a top portion configured to securely attach to the bottom portion to fully enclose the food product.

16. The system as recited in claim 9, wherein the system is configured to be washable and reusable.

* * * * *